US011835299B2

(12) United States Patent
Lee et al.

(10) Patent No.: US 11,835,299 B2
(45) Date of Patent: Dec. 5, 2023

(54) THIN VAPOR-CHAMBER STRUCTURE

(71) Applicant: Delta Electronics, Inc., Taoyuan (TW)

(72) Inventors: Kuo-Ying Lee, Taoyuan (TW); Che-Wei Chang, Taoyuan (TW); Chao-Wen Lu, Taoyuan (TW); Cherng-Yuh Su, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 113 days.

(21) Appl. No.: 17/326,079

(22) Filed: May 20, 2021

(65) Prior Publication Data

US 2022/0003507 A1 Jan. 6, 2022

(30) Foreign Application Priority Data

Jul. 3, 2020 (CN) ..... 202010631022.3

(51) Int. Cl.
*F28D 15/04* (2006.01)

(52) U.S. Cl.
CPC ..... *F28D 15/04* (2013.01)

(58) Field of Classification Search
CPC ..... F28D 15/02; F28D 15/046; F28D 15/04; F28D 15/0233; F28D 2015/0225; F28D 2015/0216
USPC ..... 165/104.26
See application file for complete search history.

(56) References Cited

U.S. PATENT DOCUMENTS 10,591,222 B2 3/2020 Zhou et al.
2019/0075682 A1* 3/2019 Shioga ..... F28D 15/0233
2019/0113288 A1* 4/2019 Cheng ..... F28D 15/0283
2019/0293358 A1* 9/2019 Kandlikar ..... F28F 13/06
2019/0368823 A1* 12/2019 Chan ..... H01L 21/4882
2020/0025458 A1* 1/2020 Takahashi ..... F28F 3/12
2020/0049419 A1* 2/2020 Machida ..... F28D 15/04
(Continued)

FOREIGN PATENT DOCUMENTS

CN 101472450 A 7/2009
CN 103839837 B 6/2016
(Continued)

OTHER PUBLICATIONS https://pubs.rsc.org/en/content/articlehtml/2018/lc/c8lc00458g (Year: 2018).*

*Primary Examiner* — Tho V Duong
(74) *Attorney, Agent, or Firm* — KIRTON McCONKIE; Evan R. Witt

(57) ABSTRACT

The disclosure relates to a thin vapor-chamber structure including a first cover and a second cover. The first cover has a first surface and a first clustered pattern. The first clustered pattern is disposed on the first surface, and has a plurality of first protruding stripes spaced apart from each other and extended along a first direction. The second cover has a second surface and a second clustered pattern. The first surface faces the second surface. The second clustered pattern is disposed on the second surface, and has a plurality of second protruding stripes spaced apart from each other and extended along a second direction. The first clustered pattern and the second clustered pattern are partially contacted with each other to form a wick. The lateral walls of the first protruding stripes and the second protruding stripes form a micro-channel meandering between the first surface and the second surface.

20 Claims, 24 Drawing Sheets

(56) References Cited

U.S. PATENT DOCUMENTS

| | | | | |
|---|---|---|---|---|
| 2021/0136955 | A1* | 5/2021 | Wakaoka | F28D 15/046 |
| 2021/0180877 | A1* | 6/2021 | Wong | H05K 7/20336 |

FOREIGN PATENT DOCUMENTS

| | | | |
|---|---|---|---|
| CN | 105758240 | A | 7/2016 |
| CN | 109479385 | A | 3/2019 |
| CN | 106376214 | B | 6/2019 |
| TW | 201531661 | A | 8/2015 |
| TW | M544373 | U | 7/2017 |

* cited by examiner

THIN VAPOR-CHAMBER STRUCTURE

FIELD OF THE INVENTION

The present disclosure relates to a vapor-chamber structure, and more particularly to a thin vapor-chamber structure for effectively eliminating the influence of vapor-liquid interference on the wicking power.

BACKGROUND OF THE INVENTION

A conventional vapor-chamber structure includes a hermetically sealed hollow vessel, a working fluid, and a closed-loop capillary recirculation system. With the liquid-vapor phase change of the working fluid, the functions of rapid heat transfer and heat diffusion are achieved.

However, the conventional vapor-chamber structure has a micro-structure formed by for example a copper mesh to generate a capillary force, and the working fluid in the conventional vapor-chamber structure is driven to circulate through evaporation and condensation. As the conventional vapor-chamber structure tends to be thinner, the chamber space of the hollow vessel is getting smaller. The vapor-phase fluid and the liquid-phase fluid formed by the working fluid flow relatively in the extremely small chamber space, which is likely to interfere with each other and cause droplets scattering in the working fluid. Consequently, the performance of the vapor chamber is affected. In addition, the interface between the vapor-phase fluid and the liquid-phase fluid that generate capillary force in the vapor chamber is formed in the height direction (i.e., the thickness direction of the vapor chamber, for example, the Z-axis direction). In that, the mutual interference area of the vapor-phase fluid and the liquid-phase fluid is equal to the planar area of the vapor chamber (i.e., the planar area formed by the length and width of the vapor chamber, such as along the X-axis direction and Y-axis direction), resulting in a larger mutual interference area between the vapor-phase fluid and the liquid-phase fluid. Consequently, the working efficiency of the vapor chamber is affected.

Therefore, there is a need of providing a thin vapor-chamber structure to effectively eliminate the influence of vapor-liquid interference on the wicking power and overcome the above drawbacks.

SUMMARY OF THE INVENTION

An object of the present disclosure is to provide a thin vapor-chamber structure. The clustered patterns on two covers are in contact connection to form a wick having at least one micro-channel, so as to provide a required wicking power for the liquid-phase fluid to flow back from the condensation zone to the evaporation zone. It effectively eliminates that the liquid-phase liquid is interfered with the vapor-phase liquid flowing from the evaporation zone to the condensation zone. The wicking power refers to the facilitation of the fluid, including the vapor-phase fluid and the liquid-phase fluid, flowing in circulation of evaporation and condensation. The effectiveness of the wicking power is related to the flow resistance and the capillary force. Since the protruding stripes on the two coves are arranged and extended along different directions, the protruding stripes on the two covers are overlapped and contacted to form a micro-channel, which meanders between the surfaces of the two covers. Thus, the liquid-phase fluid flows from the condensation zone back to the evaporation zone through the continuous micro-channel, and the required wick power is provided by two lateral walls of the protruding stripes for the fluid flowing from the condensation zone back to the evaporation zone. The flow resistance and the capillary force are inversely proportional to the height of the protruding stripes on the two covers, are directly proportional to the width of the protruding stripes on the two covers, and are inversely proportional to the spacing distance of two adjacent protruding stripes on the two covers, so that the recirculation efficiency of the fluid flowing from the condensation zone back to the evaporation zone are controlled. Furthermore, the performance of the wicking power is adjustable by changing the height and the width of the protruding stripes and the spacing distance of two adjacent protruding stripes, but is not limited to the planar dimensions of the two covers. On the other hand, the micro-channel of the wick and the flow channel located adjacent to the wick are in fluid communication with each other, so that the flow of the liquid-phase fluid in the micro-channel and the flow of the vapor-phase fluid in the flow channel are not interfered with each other. Thus, the vapor-phase fluid formed by evaporation from the evaporation zone flows through the flow channel, and the liquid-phase fluid formed by condensation from the condensation zone flows through the micro-channel, respectively. The interference caused by the mutual flows relative to each other is effectively eliminated. It also prevents the fluid from causing droplets scattering and affecting the performance of the vapor chamber.

Another object of the present disclosure is to provide a thin vapor-chamber structure. The protruding stripes of the clustered patterns on the two covers are arranged and extended along different directions, respectively. When the two covers are assembled, the protruding stripes on the two covers are in contact connection to each other, thereby forming the micro-channel, which meanders between the surfaces of the two covers. In conjunction with the corresponding condensation zone and the evaporation zone of the thin vapor-chamber structure in use, the clustered patterns on the two covers are adjustable correspondingly according to the length, the width or the shape of the two ends of the protruding stripes. Moreover, the density of the protruding stripes of the clustered patterns are adjustable, so as to meet the requirements of practical applications and increase the diversity of products. On the other hand, in addition to being assembled by diffusion bonding or brazing, the two covers are connected by an adhesive layer. It is beneficial to realize the contact connection of the protruding stripes on the two covers, simplify the process time, and reduce energy consumption. It further avoids the oxidation phenomenon caused by high-temperature and high-pressure assembly, which affects the contact connection of the protruding stripes on the two covers and the overall performance of the thin vapor-chamber structure.

According to an aspect of the present disclosure, there is a thin vapor-chamber structure including a first cover, a second cover and a fluid. The first cover has a first surface and a first clustered pattern. The first clustered pattern is disposed on the first surface and includes a plurality of first protruding stripes. The plurality of first protruding stripes are spaced apart from each other and extended along a first direction. The second cover has a second surface and a second clustered pattern. The first surface faces the second surface. The first cover and the second cover are assembled to form an accommodation space. The first clustered pattern and the second clustered pattern are spatially corresponded and connected to each other to form a wick. The wick divides the accommodation space into at least two flow channels located at two opposite sides of the wick. The second clustered pattern is disposed on the second surface and includes a plurality of second protruding stripes. The plurality of second protruding stripe are spaced apart from each other and extended along a second direction. The first direction and the second direction are non-identical. The plurality of first protruding stripes and the plurality of second protruding stripes are partially contacted to each other and configured to form at least one micro-channel in fluid communication with the at least two flow channels. The fluid is accommodated within the accommodation space. When the fluid flows through the at least one micro-channel, a capillary force generated by the plurality of first protruding stripes and the plurality of second protruding stripes provides a wicking power, so that the fluid smoothly flows in a recirculation through the flow channels and the micro-channel.

According to another aspect of the present disclosure, there is a thin vapor-chamber structure including a first cover and a second cover. The first cover has a first surface and a first clustered pattern. The first clustered pattern is disposed on the first surface and includes a plurality of first protruding stripes. The plurality of first protruding stripes are spaced apart from each other and extended along a first direction. The second cover has a second surface and a second clustered pattern. The first surface faces the second surface. The second clustered pattern is disposed on the second surface and includes a plurality of second protruding stripes, the plurality of second protruding stripe are spaced apart from each other and extended along a second direction. The first direction and the second direction are non-identical. The first clustered pattern and the second clustered pattern are spatially corresponded and in contact connection to each other to form a wick. Lateral walls of the plurality of first protruding stripes and lateral walls of the plurality of second protruding stripes are configured to form at least one micro-channel meandering between the first surface and the second surface.

The above objects and advantages of the present disclosure become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only; it is not intended to be exhaustive or to be limited to the precise form disclosed.

Figure 1:
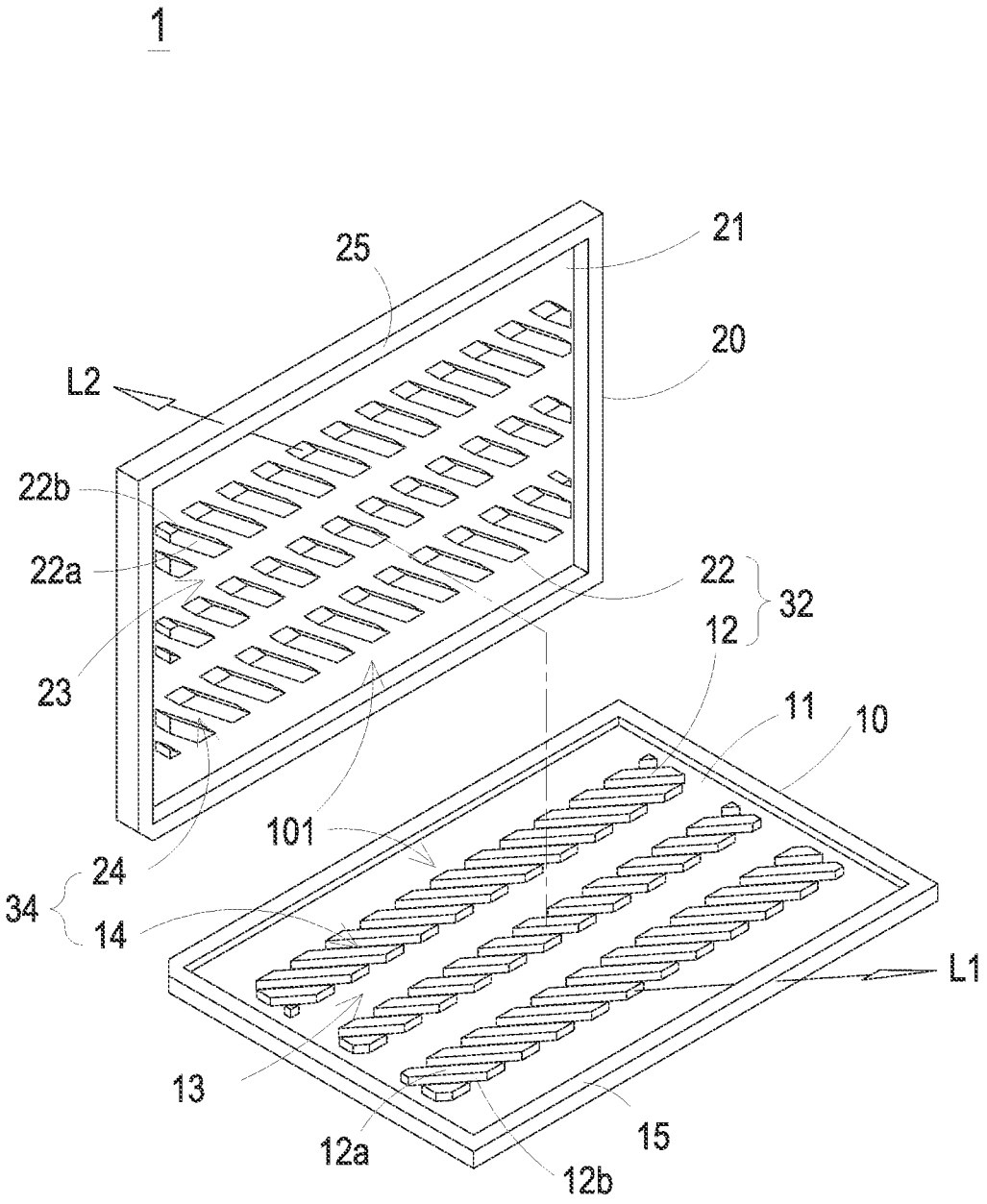
FIG. 1 shows an exploded view of the thin vapor-chamber structure according to a first embodiment of the present disclosure.
Figure 2:
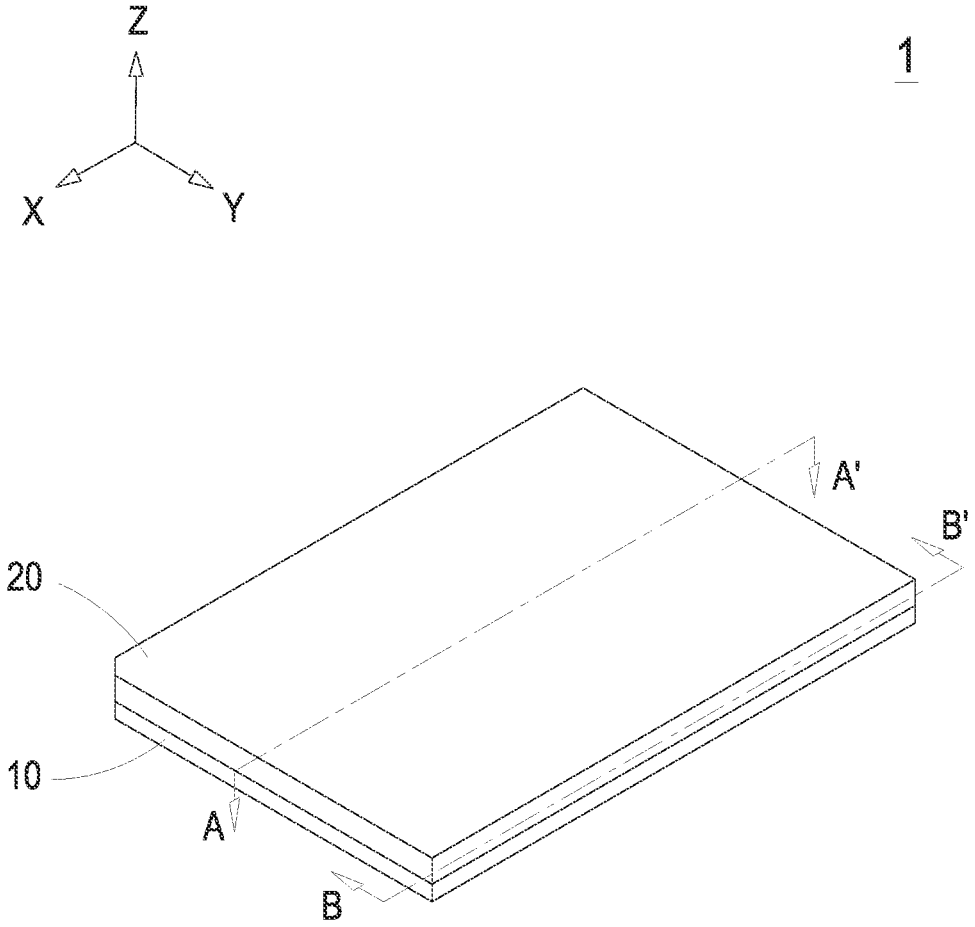
FIG. 2 shows a perspective view of the thin vapor-chamber structure according to the first embodiment of the present disclosure.
Figure 3:
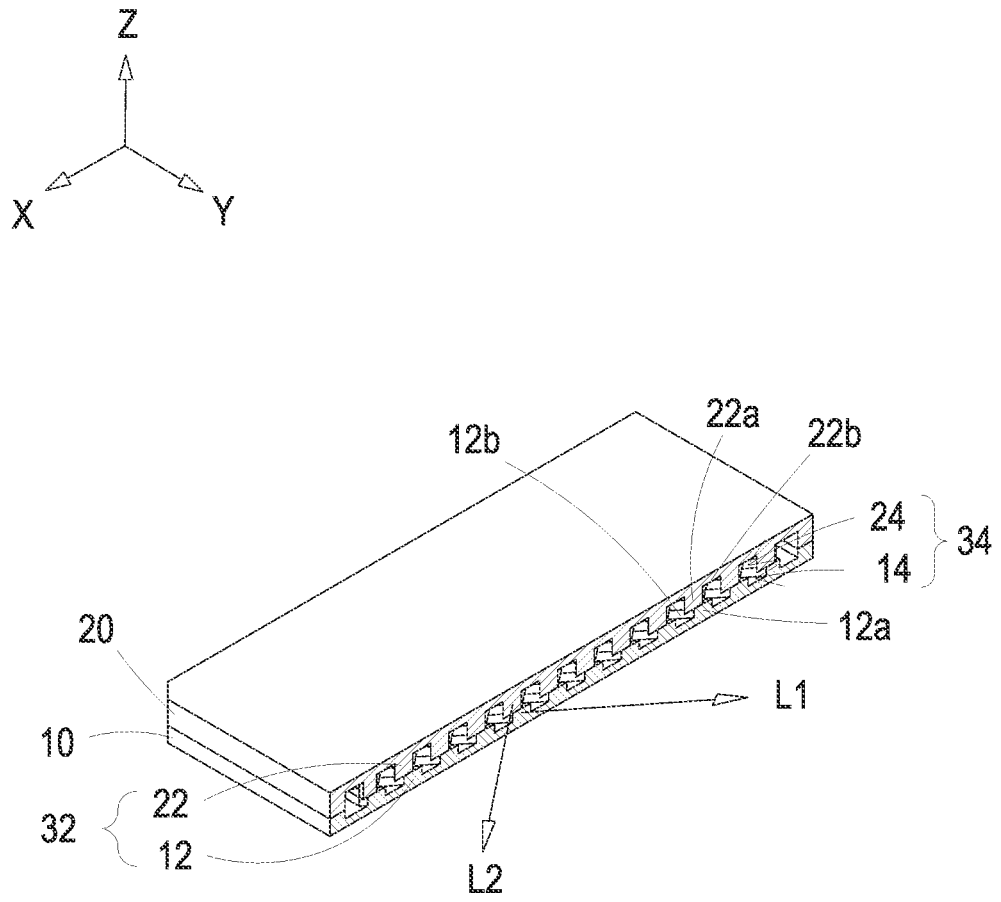
FIG. 3 shows a cross-sectional view of the thin vapor-chamber structure of FIG. 2 taken along the line A-A'.
Figure 4:
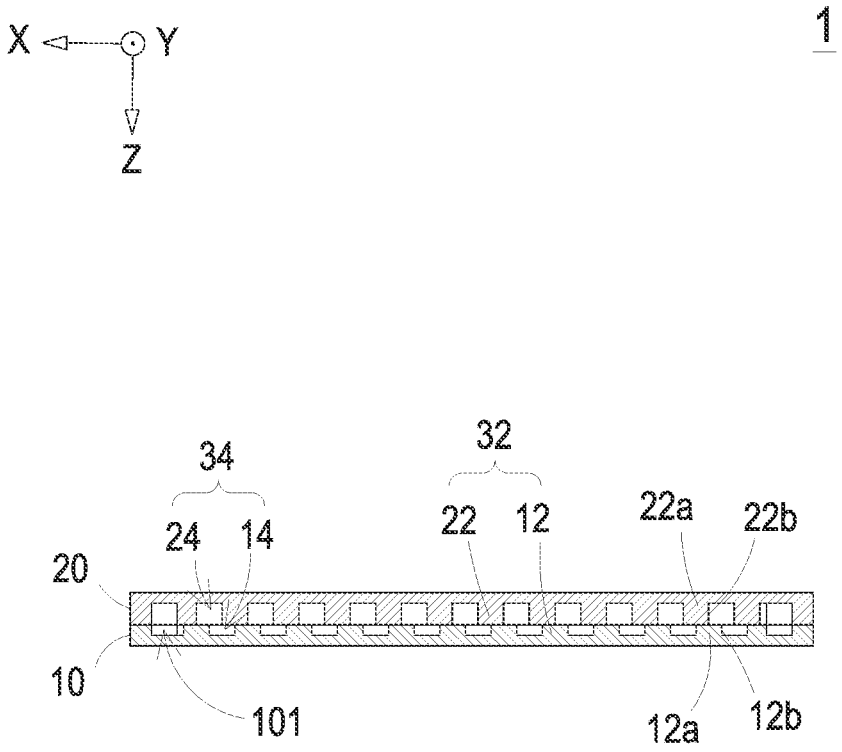
FIG. 4 is a lateral view of FIG. 3.
Figure 5:
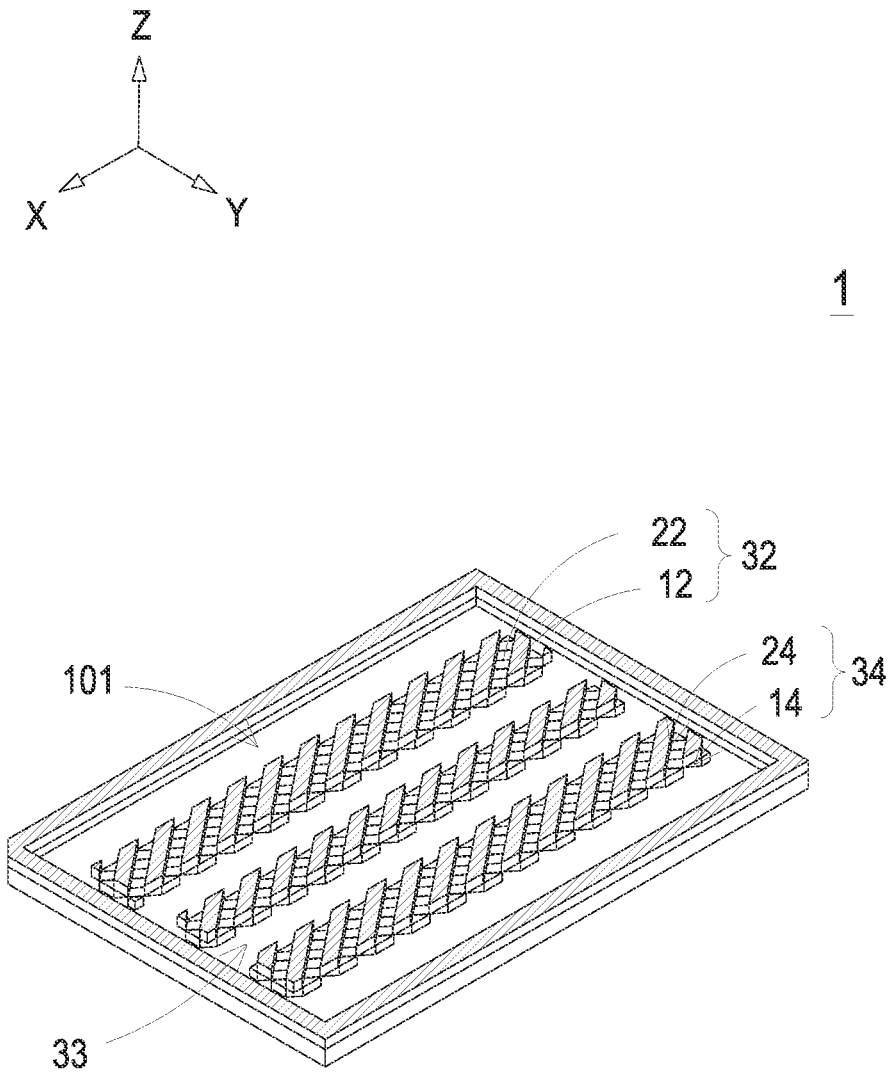
FIG. 5 shows a cross-sectional view of the thin vapor-chamber of FIG. 2 taken along the line B-B'.
Figure 6:
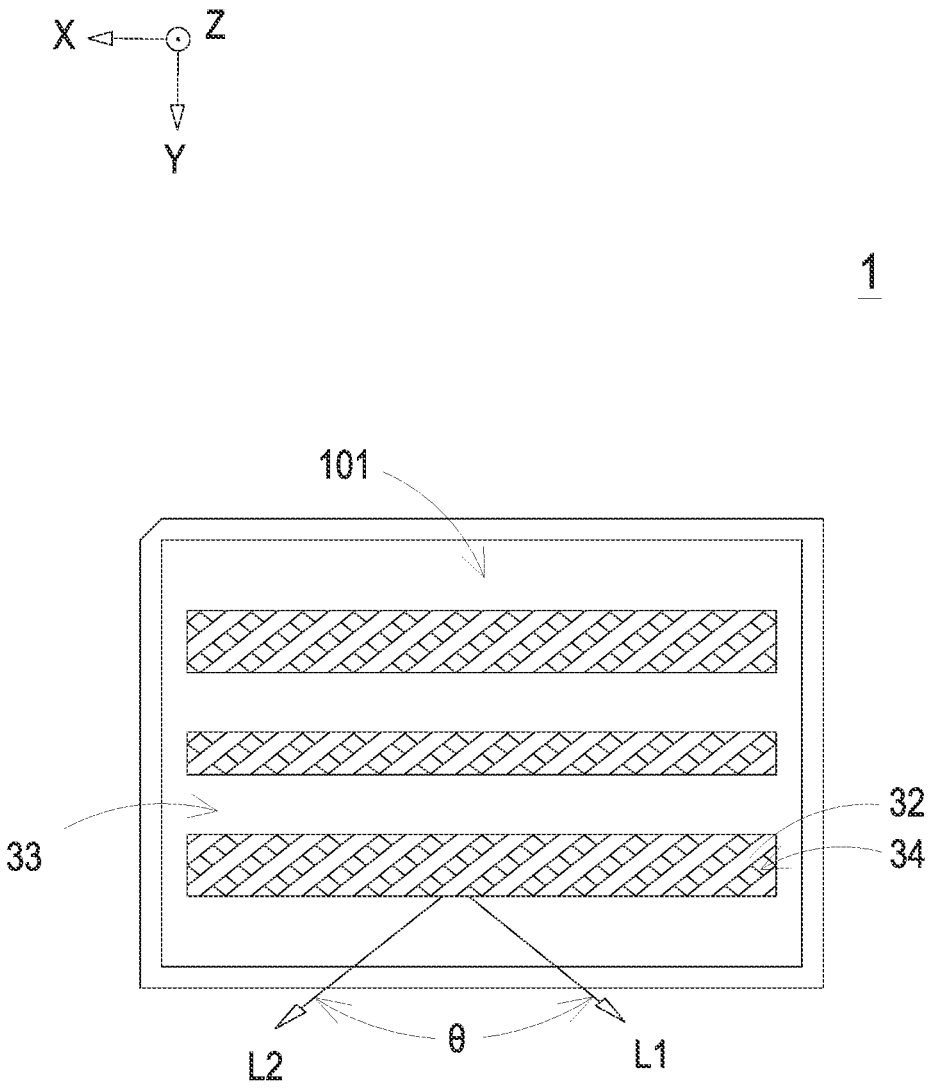
FIG. 6 is a top view of FIG. 5.

FIG. 1 shows an exploded view of the thin vapor-chamber structure according to a first embodiment of the present disclosure. FIG. 2 shows a perspective view of the thin vapor-chamber structure according to the first embodiment of the present disclosure. FIG. 3 shows a cross-sectional view of the thin vapor-chamber structure of FIG. 2 taken along the line A-A'. FIG. 4 is a lateral view of FIG. 3. FIG. 5 shows a cross-sectional view of the thin vapor-chamber of FIG. 2 taken along the line B-B'. FIG. 6 is a top view of FIG. 5. In the embodiment, the thin vapor-chamber structure 1 includes a first cover 10, a second cover 20 and a fluid (not shown). The first cover 10 has a first surface 11 and a first clustered pattern 12. The first clustered pattern 12 is disposed on the first surface 11 and includes a plurality of first protruding stripes 12*a*. The plurality of first protruding stripes 12*a* are spaced apart from each other and extended along a first direction L1. The second cover 20 has a second surface 21 and a second clustered pattern 22. The second clustered pattern 22 is disposed on the second surface 21 and includes a plurality of second protruding stripes 22*a*. The plurality of second protruding stripes 22*a* are spaced apart from each other and extended along a second direction L2.

In the embodiment, the first direction L1 and the second direction L2 are non-identical. Namely, the first direction L1 and the second direction L2 are not parallel to each other. Therefore, the first direction L1 and the second direction L2 form an angle θ, and the angle θ is ranged from 20° to 160°. In the embodiment, the first surface 11 faces the second surface 21. The first cover 10 and the second cover 20 are assembled to form an accommodation space 101. The first clustered pattern 12 and the second clustered pattern 22 are spatially corresponded and connected to each other to form a wick (also called as a micro-structure) 32. In the embodiment, the wick 32 divides the accommodation space 101 into at least two flow channels 33 located at two opposite sides of the wick 32. Preferably but not exclusively, in the embodiment, the flow channels 33 are formed by the first lateral interval 13 disposed between two opposite lateral sides of the first clustered pattern 12 and the second lateral interval 23 disposed between two opposite lateral sides of the second clustered pattern 22. Moreover, in the embodiment, the surfaces of the first protruding stripes 12*a* and the surfaces of the second protruding stripes 22*a* are at least partially contacted to each other and configured to form the wick 32, and the wick 32 includes at least one micro-channel 34 in fluid communication with the at least two flow channels 33. In the embodiment, each two adjacent first protruding stripes 12*a* have a first space 14, and each two adjacent second protruding stripes 22*a* have a second space 24. Preferably but not exclusively, the first space 14 and the second space 24 are in fluid communication with each other to form the micro-channel 34. In the embodiment, the fluid is accommodated within the accommodation space 101. Preferably but not exclusively, the accommodation space 101 is fully filled by the fluid, and the fluid includes a vapor-phase fluid and a liquid-phase fluid. The flow channel 33 is for the vapor-phase fluid flowing therethrough, and the micro-channel 34 is for the liquid-phase fluid flowing therethrough. When the liquid-phase fluid flows through the at least one micro-channel 34, a capillary force generated by the plurality of first protruding stripes 12*a* and the plurality of second protruding stripes 22*a* provides a wicking power, so that the vapor-phase fluid and the liquid-phase fluid are smoothly flowing in a recirculation through the flow channels 33 and the micro-channel 34, respectively. Namely, the recirculation flow of evaporation and condensation is performed smoothly.

In the embodiment, the first cover 10 includes a first connection portion 15 disposed around a peripheral edge of the first cover 10. The second cover 20 includes a second connection portion 25 disposed around a peripheral edge of the second cover 20. In the embodiment, the first cover 10, the first clustered pattern 12 and the first connection portion 15 are formed by for example but not limited to the copper, the aluminum or the other thermal-conductive metal, and integrated into one piece. In the embodiment, the second cover 20, the second clustered pattern 22 and the second connection portion 25 are formed by for example but not limited to the copper, the aluminum or the other thermal-conductive metal, and integrated into one piece. Preferably but not exclusively, the first connection portion 15 of the first cover 10 and the second connection portion 25 of the second cover 20 are assembled by diffusion bonding or brazing, so as to form the sealed accommodation space 101. At the same time, the first clustered pattern 12 and the second clustered pattern 22 are in contact connection to form the wick 32 having at least one micro-channel 34. Certainly, in some other embodiments, the first cover 10 and the second cover 20 are assembled by the other bonding methods to form the sealed accommodation space 101, and make sure that the first clustered pattern 12 and the second clustered pattern 22 are in contact connection to form the wick 32 having at least one micro-channel 34. Notably, the least one micro-channel 34 is formed by the lateral walls 12*b* of the plurality of first protruding stripes 12*a* and the lateral walls 22*b* of the second protruding stripes 22*a*, so that the micro-channel 34 is meandered between the first surface 11 and the second surface 21. Thus, the plurality of first protruding stripes 12*a* and the plurality of second protruding stripes 22*a* are combined to generate a capillary force when the fluid flows therethrough, and the wicking power is provided. It is beneficial to realize that the vapor-phase fluid and the liquid-phase fluid are smoothly flowing in the recirculation through the flow channels 33 and the micro-channel 34, respectively. Namely, the recirculation flow of evaporation and condensation is performed smoothly.

Figure 7:
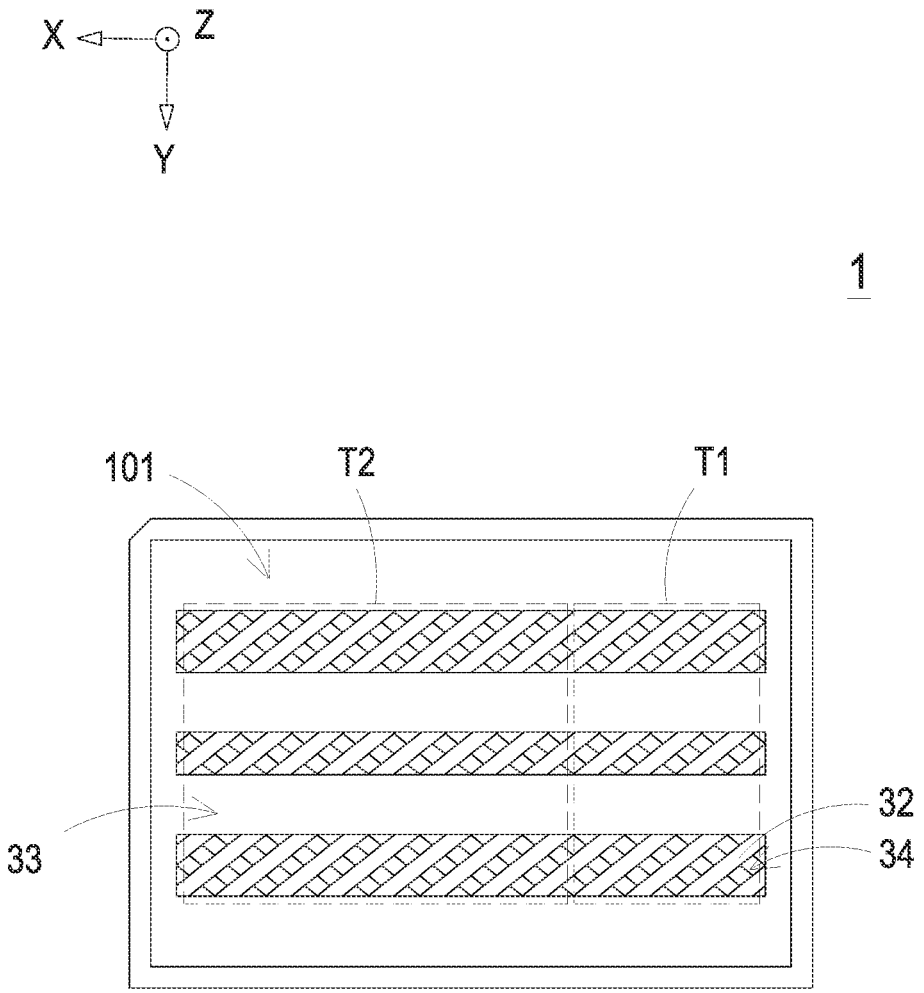
FIG. 7 shows a relative position of an evaporation zone and a condensation zone of the thin vapor-chamber structure according to the first embodiment of the present disclosure.

In the embodiment, the fluid, for example, is fully filled in the sealed accommodation space 101, and the fluid includes the vapor-phase fluid and the liquid-phase fluid. Preferably but not exclusively, when the thin vapor-chamber structure 1 provides a heat dissipation function for an electronic component that generates a heat source, the area in contact with the electronic component is represented as an evaporation zone and the other area is represented as a condensation zone. FIG. 7 shows a relative position of an evaporation zone and a condensation zone of the thin vapor-chamber structure according to the first embodiment of the present disclosure. In the embodiment, the thin vapor-chamber structure 1 includes an evaporation zone T1 and a condensation zone T2. In use, the fluid located in the evaporation zone T1 is evaporated by, for example, the heat energy generated by the corresponding electronic component to form the vapor-phase fluid. At this time, the vapor-phase fluid passes through the flow channel 33 and flows from the evaporation zone T1 to the condensation zone T2, so as to release the heat energy and condense into the liquid-phase fluid. On the other hand, the micro-channel 34 formed by the lateral walls 12*b* of the plurality of first protruding stripes 12*a* and the lateral walls 22*b* of the plurality of second protruding stripes 22*a* is meandered between the first surface 11 and the second surface 21. When the liquid-phase fluid flows into the micro-channel 34 of the wick 32 due to the wicking power, the liquid-phase fluid flows from the condensation zone T2 back to the evaporation zone T1. Thus, the vapor-phase fluid and the liquid-phase fluid flow in the recirculation through the flow channels 33 and the micro-channel 34, respectively. The capillary force generated from the interface between the vapor-phase fluid and the liquid-phase fluid is formed in the length direction and the width direction of the thin vapor-chamber structure 1. The length direction and the width direction are the planar directions of the vapor-chamber structure, i.e., the X-axis direction and the Y-axis direction). Comparing to the conventional vapor-chamber structure, the interference area between the vapor-phase fluid and the liquid-phase fluid becomes smaller. Therefore, the interference caused by the mutual flows of the vapor-phase fluid and the liquid-phase fluid is effectively eliminated. It also prevents the mutual flows of the vapor-phase fluid and the liquid-phase fluid from causing droplets scattering and affecting the performance of the vapor-chamber structure.

Figure 8:
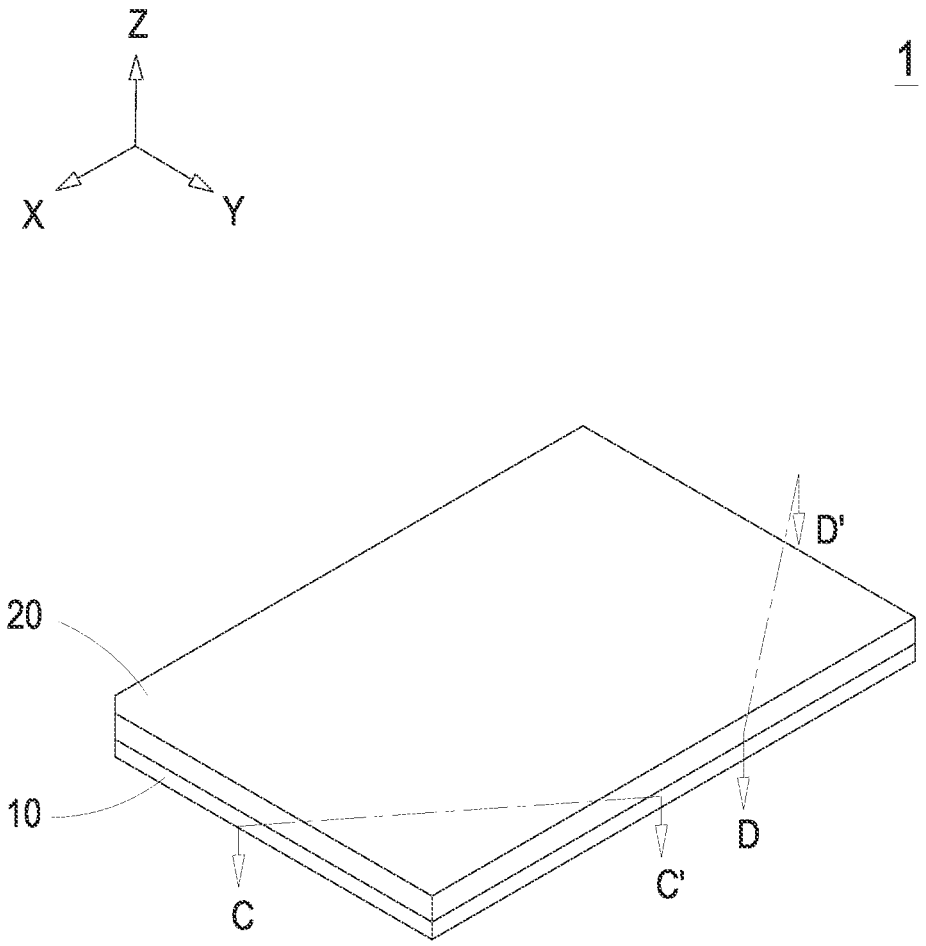
FIG. 8 shows the thin vapor-chamber structure of FIG. 2.
Figure 9:
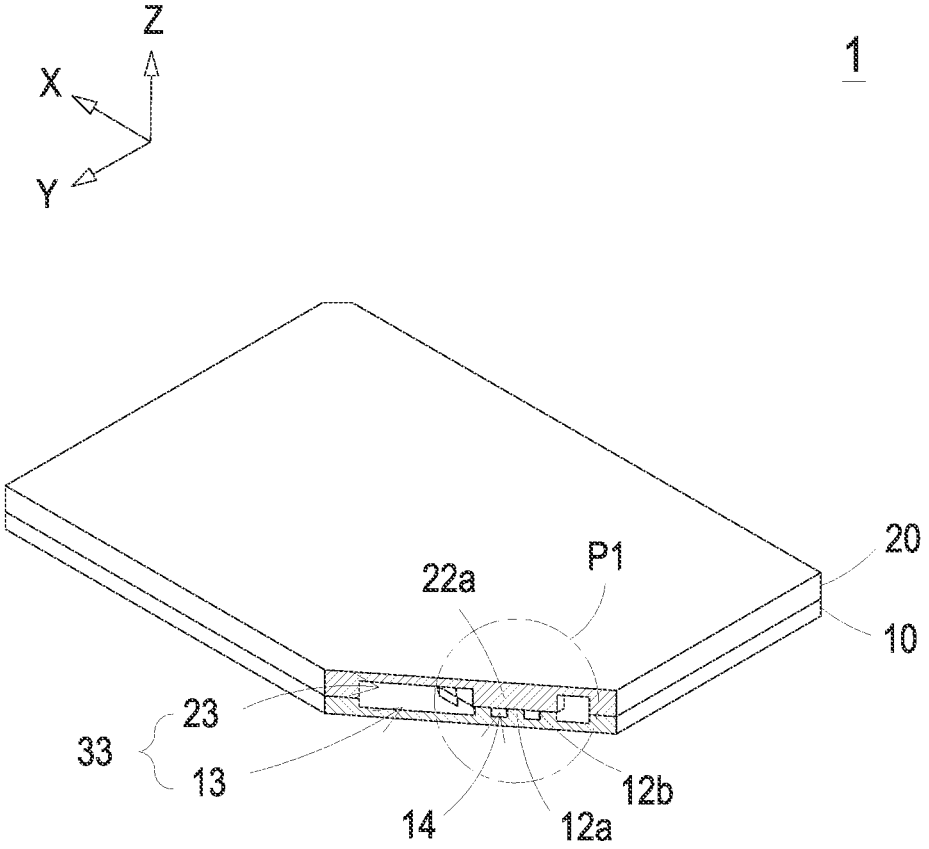
FIG. 9 shows a cross-sectional view of the thin vapor-chamber structure of FIG. 8 taken along the line C-C'.
Figure 10:
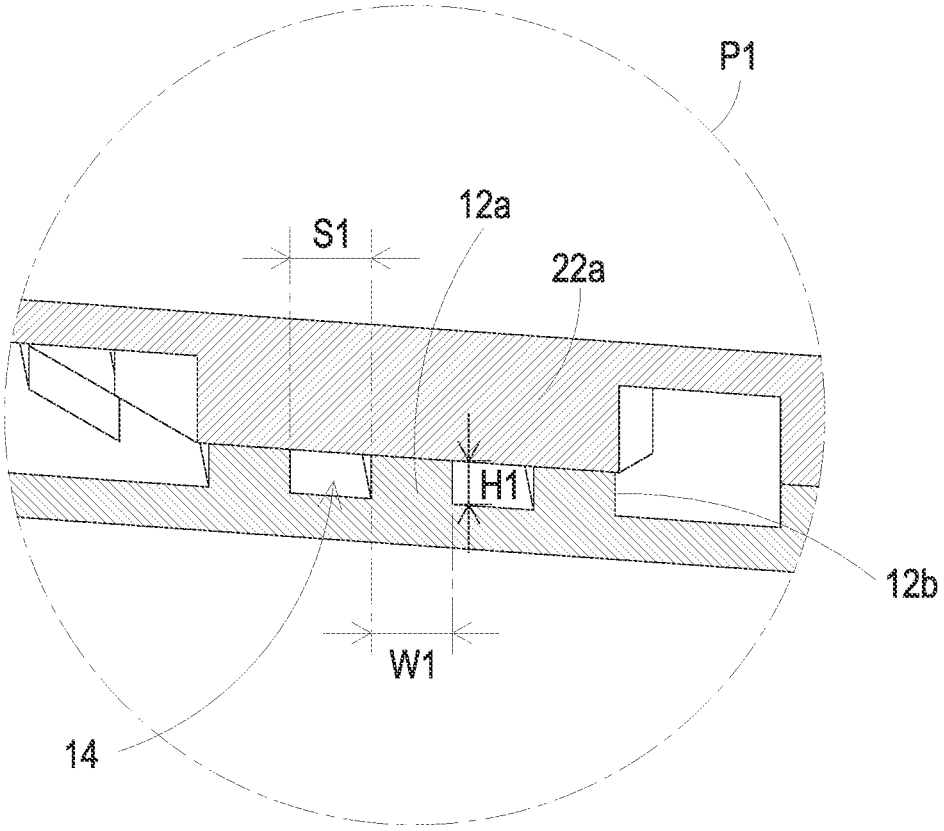
FIG. 10 shows an enlarged view of the area P1 in FIG. 9.
Figure 11:
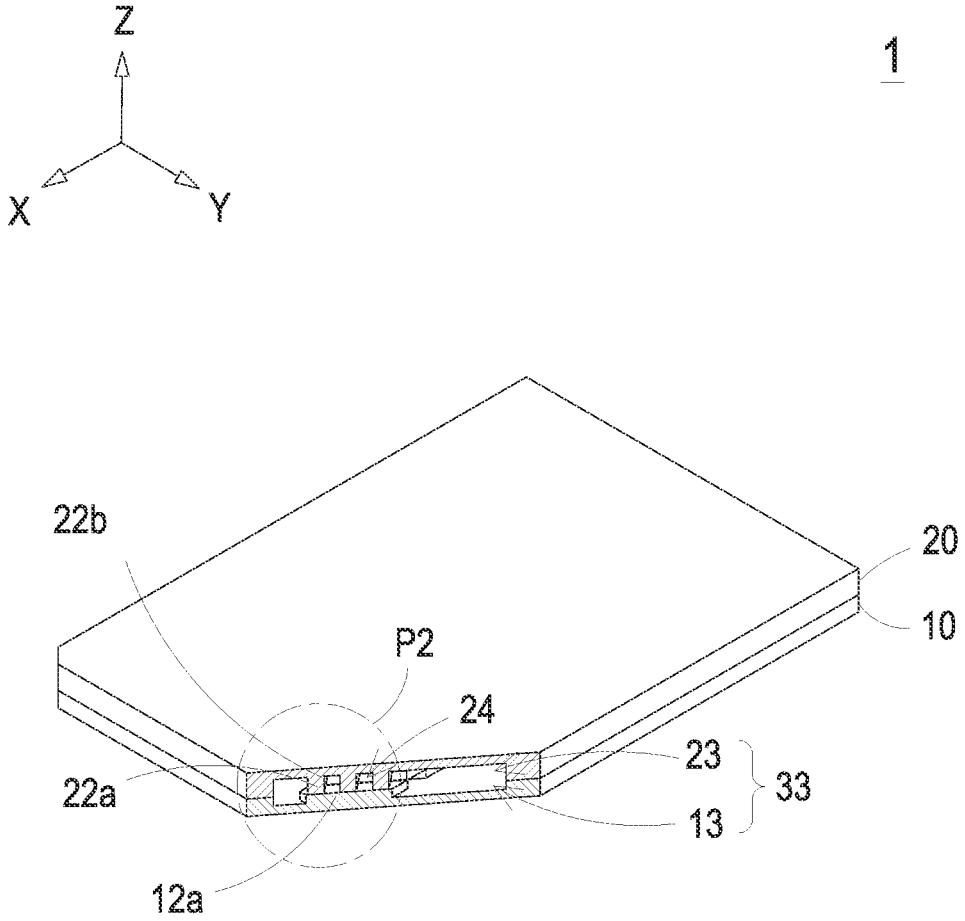
FIG. 11 shows a cross-sectional view of the thin vapor-chamber structure of FIG. 8 taken along the line D-D'.
Figure 12:
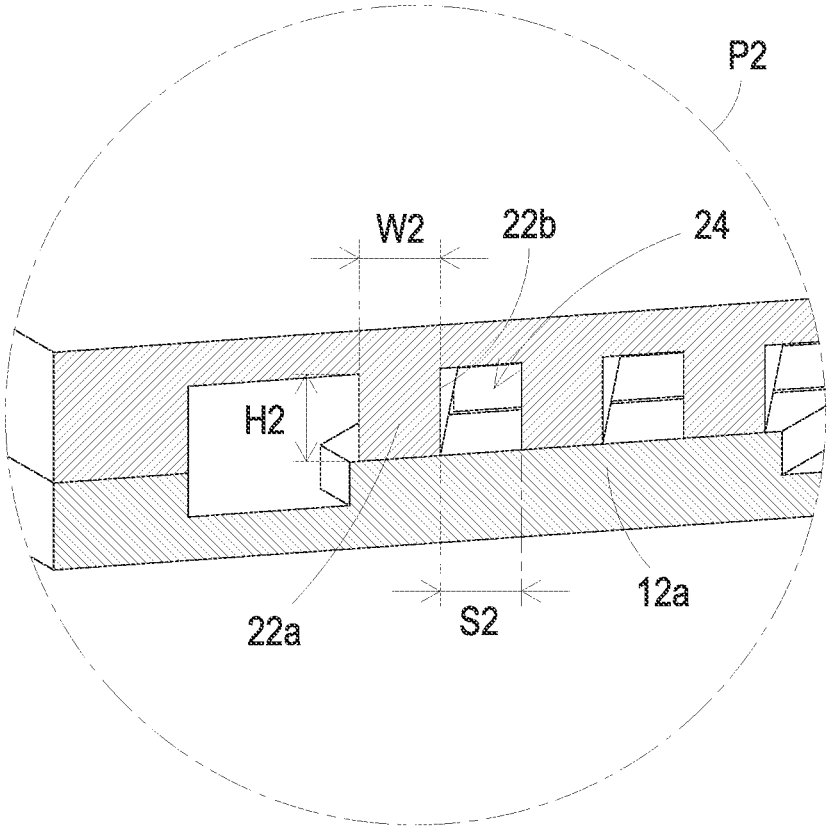
FIG. 12 shows an enlarged view of the area P2 in FIG. 11.

FIG. 8 shows the thin vapor-chamber structure of FIG. 2. FIG. 9 shows a cross-sectional view of the thin vapor-chamber structure of FIG. 8 taken along the line C-C'. FIG. 10 shows an enlarged view of the area P1 in FIG. 9. FIG. 11 shows a cross-sectional view of the thin vapor-chamber structure of FIG. 8 taken along the line D-D'. FIG. 12 shows an enlarged view of the area P2 in FIG. 11. In the embodiment, each two adjacent first protruding stripes 12*a* have a first spacing distance S1, and the first spacing distance S1 is ranged from 50 microns to 300 microns. The first protruding stripe 12*a* has a first height H1 and a first width W1, the first height H1 is ranged from 10 microns to 200 microns, and the first width W1 is ranged from 50 microns to 500 microns. Moreover, in the embodiment, each two adjacent second protruding stripes 22*a* have a second spacing distance S2, and the second spacing distance S2 is ranged from 50 microns to 300 microns. The second protruding stripe 22*a* has a second height H2 and a second width W2, the second height H2 is ranged from 10 microns to 200 microns, and the second width W2 is ranged from 50 microns to 500 microns. Preferably but not exclusively, the first height H1 of the first protruding stripe 12*a* is less than the second height H2 of the second protruding stripe 22*a*. In the embodiment, the first clustered pattern 12 on the first cover 10 includes the plurality of first protruding stripes 12*a* arranged and extended along the first direction L1, and the second clustered pattern 22 on the second cover 20 includes the plurality of second protruding stripes 22*a* arranged and extended along the second direction L2. After the plurality of first protruding stripes 12*a* and the plurality of second protruding stripes 22*a* are overlapped and contacted, the micro-channel 34 is formed and meandered between the first surface 11 and the second surface 21. Thus, the liquid-phase fluid flows from the condensation zone T2 back to the evaporation zone T1 through the continuous micro-channel 34, the capillary force is generated by the first protruding stripes 12*a* and the second protruding stripes 22*a* overlapped and contacted, and the required wick power is provided for the liquid-phase fluid flowing from the condensation zone T2 back to the evaporation zone T1. In the embodiment, the flow resistance and the capillary force are inversely proportional to the first height H1 of the first protruding stripe 12*a* and the second height H2 of the second protruding stripe 22*a*. In addition, the flow resistance and the capillary force are directly proportional to the first width W1 of the first protruding stripe 12*a* and the second width W2 of the second protruding stripe 22*a*. On the other hand, the flow resistance and the capillary force are inversely proportional to the first spacing distance S1 of each two adjacent first protruding stripes 12*a* and inversely proportional to the second spacing distance S2 of each two adjacent second protruding stripes 22*a*. Therefore, the efficiency of the wicking power for the liquid-phase fluid flowing from the condensation zone T2 back to the evaporation zone T1 can be controlled by adjusting the first height H1, the first width W1 and the first spacing distance S1 of the first protruding stripes 12*a* and the second height H2, the second width W2 and the second spacing distance S2 of the second protruding stripes 22*a*. Namely, the efficiency of the wicking power in the thin vapor-chamber structure 1 is adjusted by changing the first height H1, the first width W1 and the first spacing distance S1 of each two adjacent first protruding stripes 12*a*, or by changing the second height H2, the second width W2 and the second spacing distance S2 of each two adjacent second protruding stripes 22*a*. The efficiency of the wicking power in the thin vapor-chamber structure 1 is not limited to the planar dimensions of the first cover 10 and the second cover 20.

Figure 13:
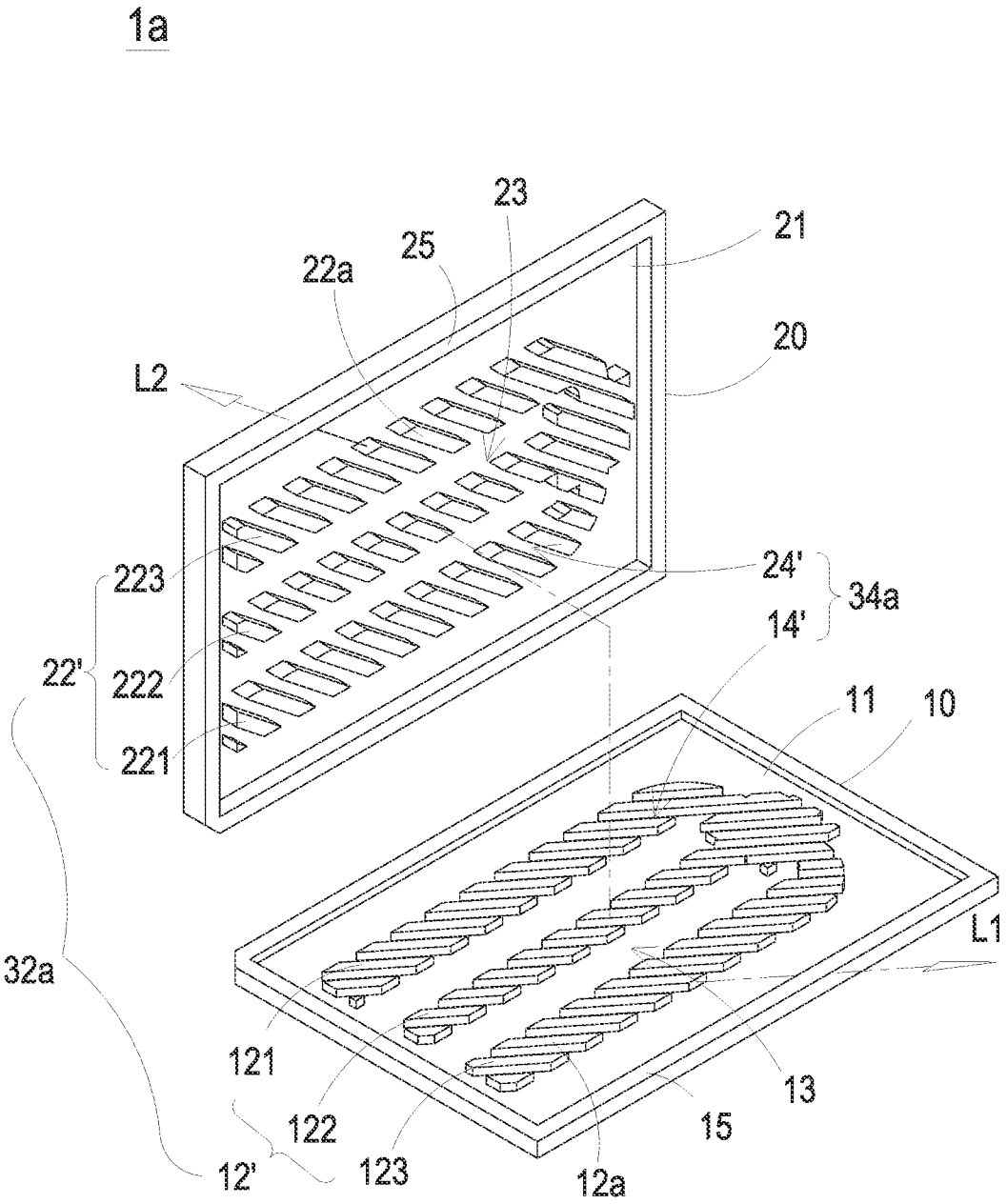
FIG. 13 shows an exploded view of the thin vapor-chamber structure according to a second embodiment of the present disclosure.
Figure 14:
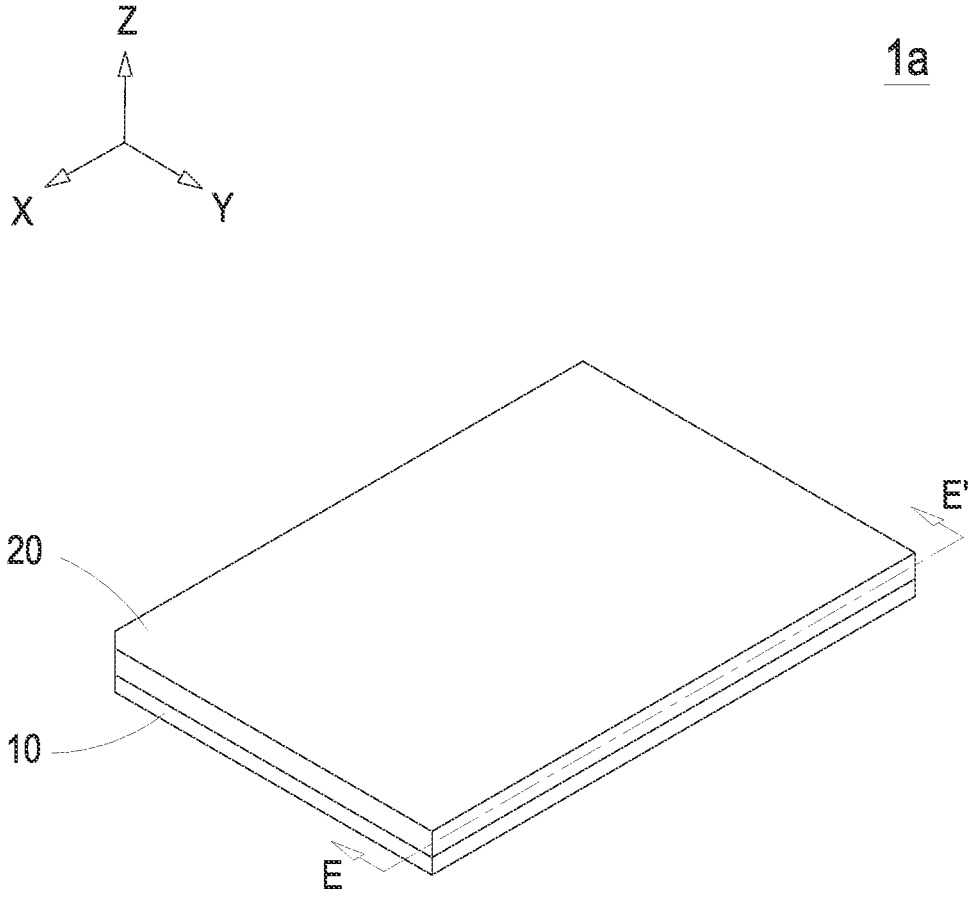
FIG. 14 shows a perspective view of the thin vapor-chamber structure according to the second embodiment of the present disclosure.
Figure 15:
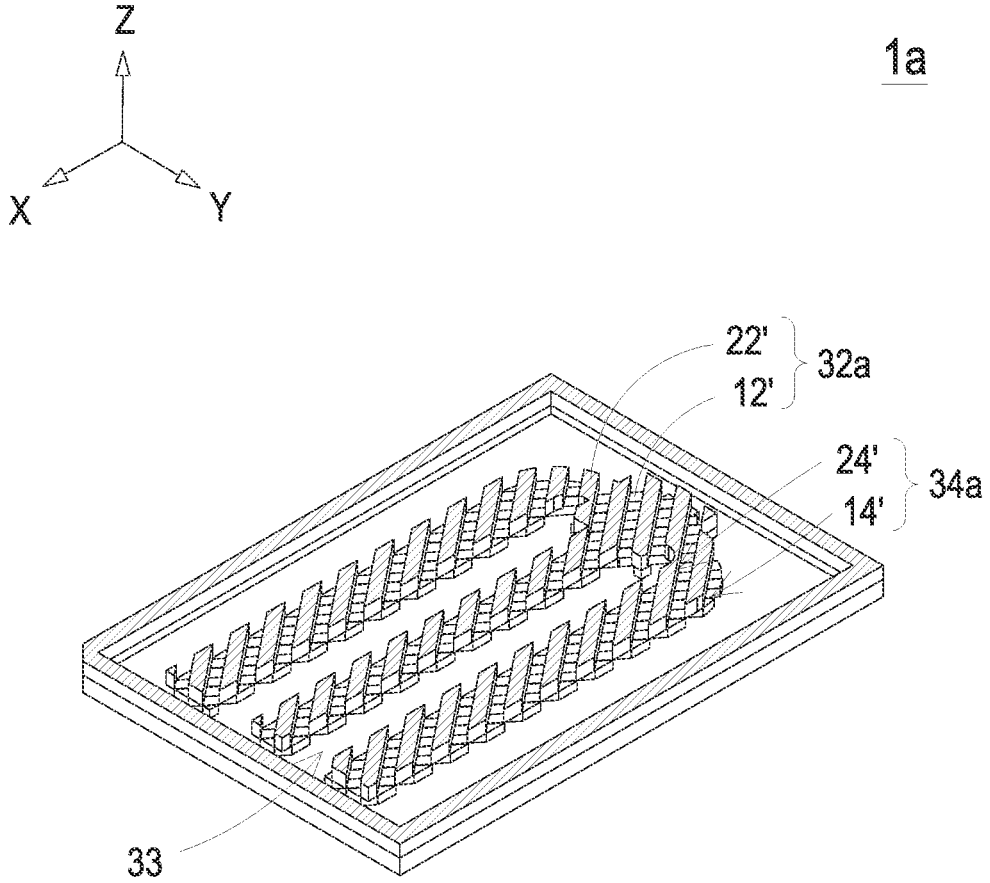
FIG. 15 shows a cross-sectional view of the thin vapor-chamber structure of FIG. 14 taken along the line E-E'.
Figure 16:
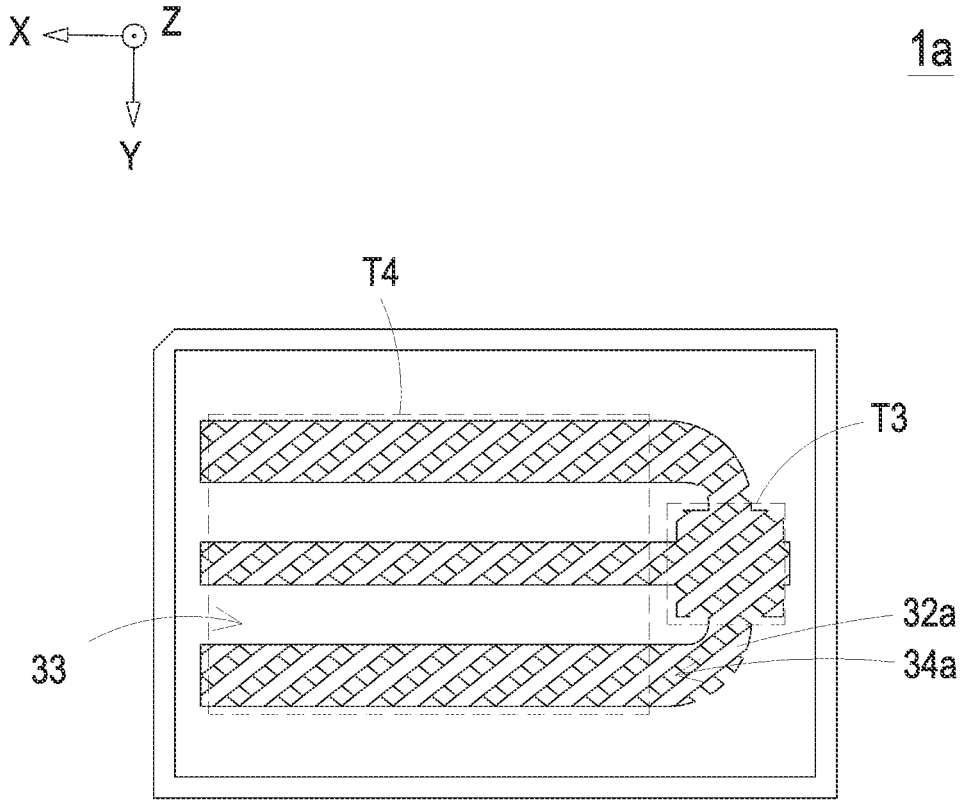
FIG. 16 shows a relative position of an evaporation zone and a condensation zone of the thin vapor-chamber structure according to the second embodiment of the present disclosure.
Figure 17A:
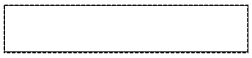
FIGS. 17A to 17J are exemplary implementations of the protruding stripes in the thin vapor-chamber structure of the present disclosure.
Figure 17B:
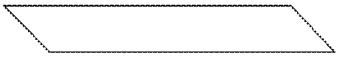
Figure 17C:
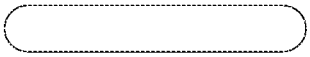
Figure 17D:
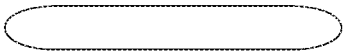
Figure 17E:
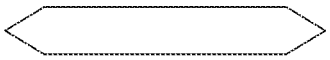
Figure 17F:
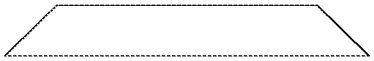
Figure 17G:
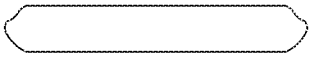
Figure 17H:
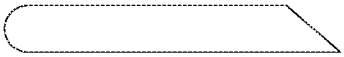
Figure 17I:
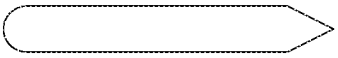
Figure 17J:
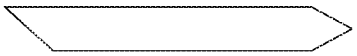

FIG. 13 shows an exploded view of the thin vapor-chamber structure according to a second embodiment of the present disclosure. FIG. 14 shows a perspective view of the thin vapor-chamber structure according to the second embodiment of the present disclosure. FIG. 15 shows a cross-sectional view of the thin vapor-chamber structure of FIG. 14 taken along the line E-E'. FIG. 16 shows a relative position of an evaporation zone and a condensation zone of the thin vapor-chamber structure according to the second embodiment of the present disclosure. In the embodiment, the structures, elements and functions of the thin vapor-chamber structure 1*a* are similar to those of the thin vapor-chamber structure 1 in FIGS. 1 to 12. The elements and features indicated by the numerals similar to those of the first embodiment mean similar elements and features, and are not redundantly described herein. In the embodiment, the first clustered pattern 12' on the first cover 10 and the second clustered pattern 22' on the second cover 20 are configured to form the wick 32*a*, and the wick 32*a* includes at least one micro-channel 34*a* disposed therein and in fluid communication with the flow channels 33. In the embodiment, each two adjacent first protruding stripes 12*a* have a first space 14', and each two adjacent second protruding stripes 22*a* have a second space 24'. Preferably but not exclusively, the first space 14' and the second space 24' are in fluid communication with each other to form the micro-channel 34*a*. In the embodiment, the arrangements of the first clustered pattern 12' on the first cover 10 and the second clustered pattern 22' on the second cover 20 are designed according to the positions of the evaporation zone T3 and the condensation zone T4 in use. In the embodiment, the first clustered pattern 12' on the first cover 10 further includes three first sub-clustered patterns 121, 122, 123. The second clustered pattern 22' includes three second sub-clustered patterns 221, 222, 223. In the embodiment, the first clustered pattern 12' is connected to the second clustered pattern 22' to form the wick 32*a*, which is disposed in the evaporation zone T3 and the condensation zone T4. Preferably but not exclusively, at least two of the first sub-clustered patterns 121, 122, 123 are spaced apart from each other in the condensation zone T4, and converged in the evaporation zone T3. At least two of the second sub-clustered patterns 221, 222, 223 are spaced apart from each other in the condensation zone T4, and converged in the evaporation zone T3. In addition, the first lateral interval 13 disposed between two opposite lateral sides of the at least two first clustered pattern 121, 122, 123 and the second lateral interval 23 disposed between two opposite lateral sides of the at least two clustered pattern 221, 222, 223 spatially correspond to each other, and are configured to form the flow channels 33. In the embodiment, when the liquid-phase fluid in the evaporation zone T3 is evaporated into the vapor-phase fluid, the vapor-phase fluid flows from the evaporation zone T3 to the condensation zone T4 through the flow channels 33. Moreover, when the liquid-phase fluid flows into the micro-channel 34 of the wick 32, the capillary force generated by the first protruding stripes 12*a* and the second protruding stripes 22*a* is provided for the wick power, and the liquid-phase fluid flows from the condensation zone T4 back to the evaporation zone T3. In some other embodiments, the densities of the first protruding stripes 12*a* of the first clustered pattern 12' and the second protruding stripes 22*a* of the second clustered pattern 22' are adjustable, so as to meet the requirements of practical applications and increase the diversity of products. The present disclosure is not limited thereto.

Notably, in the foregoing embodiments, the flow channels 33 are in fluid communication with the micro-channel 34, 34*a*. In order to improve the efficiency of the fluid entering the micro-channels 34, 34*a* from the flow channels 33 or entering the flow channel 33 from the micro-channels 34, 34*a*, the profiles of the first protruding stripes 12*a* and the second protruding stripes 22*a* are adjustable according to the practical requirements. FIGS. 17A to 17J are exemplary implementations of the protruding stripes in the thin vapor-chamber structure of the present disclosure. In the embodiment, the first protruding stripe 12*a* and the second protruding stripe 22*a* are for example a long stripe, which has a first end portion and a second end portion. Preferably but not exclusively, each of the first end portion and the second end portion includes one selected from the group consisting of a plane, a bevel, an arc, a triangle and an irregular surface, as shown in FIGS. 17A to 17J. Certainly, the present disclosure is not limited thereto.

Figure 18:
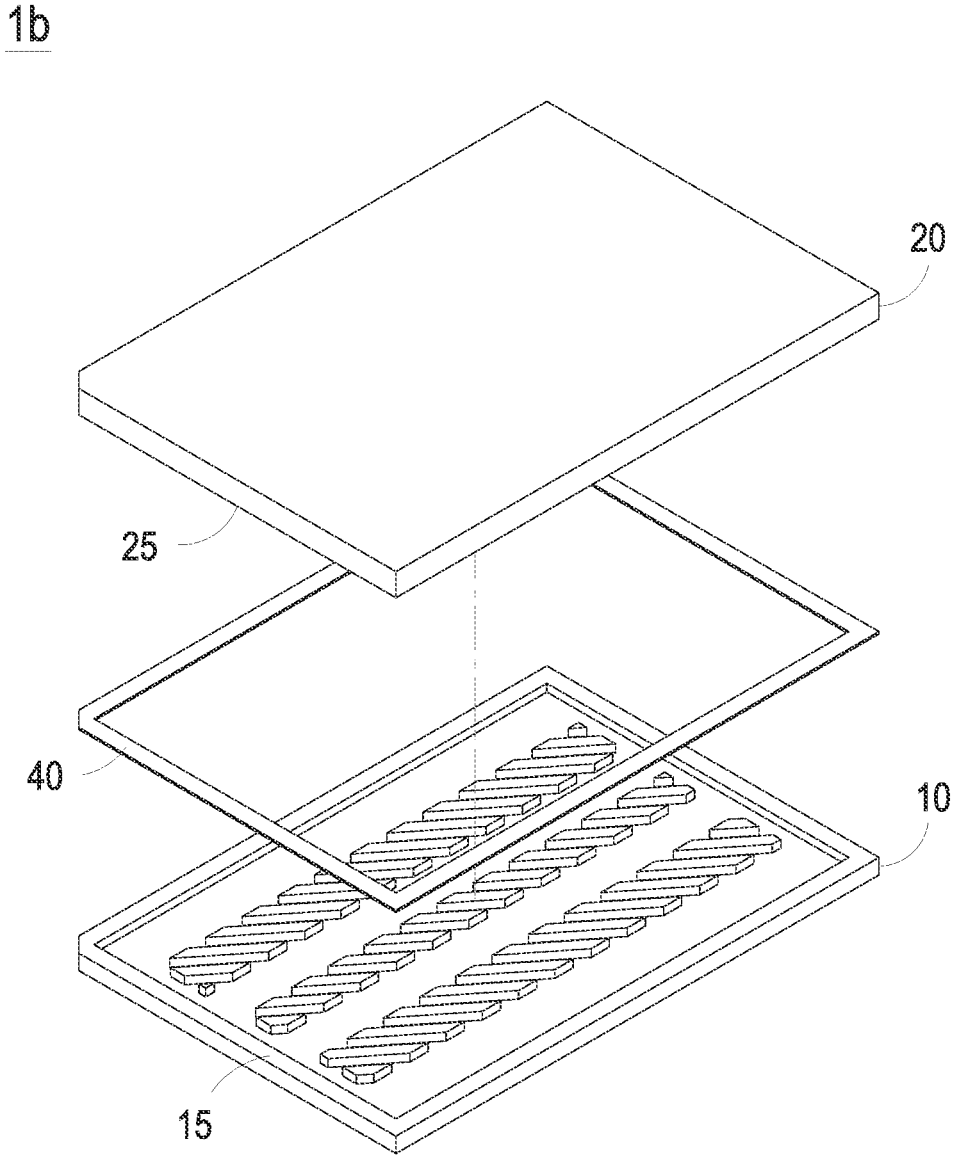
FIG. 18 shows an exploded view of the thin vapor-chamber structure according to a third embodiment of the present disclosure.

FIG. 18 shows an exploded view of the thin vapor-chamber structure according to a third embodiment of the present disclosure. In the embodiment, the structures, elements and functions of the thin vapor-chamber structure 1*b* are similar to those of the thin vapor-chamber structure 1 in FIGS. 1 to 12. The elements and features indicated by the numerals similar to those of the first embodiment mean similar elements and features, and are not redundantly described herein. In the embodiment, the thin vapor-chamber structure 1*b* further includes an adhesive layer 40 disposed between the first connection portion 15 of the first cover 10 and the second connection portion 25 of the second cover 20. By connecting the first connection portion 15 and the second connection portion 25 through the adhesive layer 40, the first cover 10 and the second cover 20 are assembled to form the accommodation space 101, and the first clustered pattern 12 and the second clustered pattern 22 are in contact connection to form the wick 32 having the at least one micro-channel 34. Notably, for the formation of the at least one micro-channel 34 in the wick 32, it has to ensure that the first clustered pattern 12 and the second clustered pattern 22 are in contact connection. In the embodiment, the first clustered pattern 12 and the first connection portion 15 of the first cover 10 are integrally formed into one piece, and the second clustered pattern 22 and the second connection portion 25 of the second cover 20 are integrally formed into one piece. While the first connection portion 15 and the second connection portion 25 are connected through the adhesive layer 40, it is beneficial to avoid the dimensional tolerance of the first connection portion 15 or the second connection portion 25 in the manufacturing process from affecting the contact connection between the first clustered pattern 12 and the second clustered pattern 22. Preferably but not exclusively, in an embodiment, the total height of the first connection portion 15 and the second connection portion 25 is less than the sum of the first height H1 of the first protruding stripe 12*a* and the second height H2 of the second protruding stripe 22*a*. By adjusting the height difference through the adhesive layer 40, it ensures that the first clustered pattern 12 and the second clustered pattern 22 are in contact connection. On the other hand, comparing to the combination of diffusion bonding and brazing under high temperature and high pressure, in the embodiment, the first cover 10 and the second cover 20 are assembled through the adhesive layer 40, and it is carried out in a lower temperature environment. Therefore, the process time is short, the energy consumption is low, and the oxidation phenomenon caused by high temperature and high pressure assembly is avoided. It ensures that the first protruding stripes 12*a* on the first cover 10 and the second protruding stripes 22*a* on the second cover 20 are in contact connection effectively. Moreover, the overall performance of the thin vapor-chamber structure 1*b* is achieved. In the embodiment, the adhesive layer 40 includes at least one selected from the group consisting of a glue, an adhesive, a tape, a binder and an epoxy resin. The present disclosure is not limited thereto.

Figure 19A:
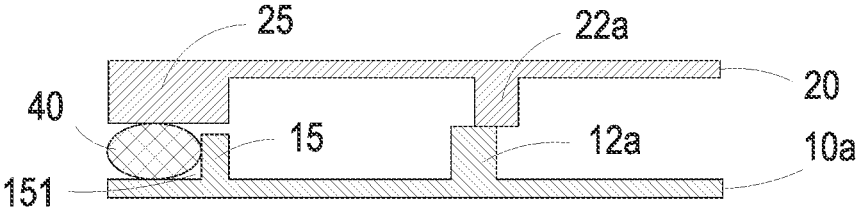
FIG. 19A to 19D are exemplary implementations of the assembly of the first cover and the second cover in the thin vapor-chamber structure of the present disclosure.
Figure 19B:
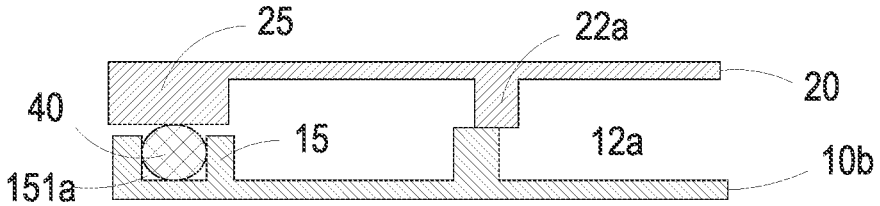
Figure 19C:
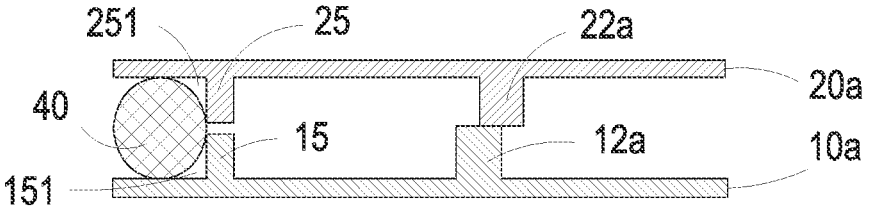
Figure 19D:
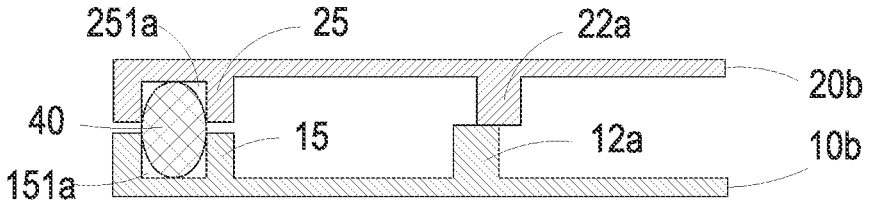

On the other hand, in order to improve the assembling effect of the first cover 10 and the second cover 20 through the adhesive layer 40, the shapes of the first connection portion 15 and the second connection portion 25 are adjustable according to the practical requirements. FIG. 19A to 19D are exemplary implementations of the assembly of the first cover and the second cover in the thin vapor-chamber structure of the present disclosure. In an embodiment, as shown in FIG. 19A, the first connection portion 15 of the first cover 10*a* further includes a concave area 151, and the adhesive layer 40 is at least partially accommodated in the concave area 151, so that the contact area between the adhesive layer 40 and the first connection portion 15 is increased, and the assembling effect of the first cover 10*a* and the second cover 20 through the adhesive layer 40 is improved. In an embodiment, as shown in FIG. 19B, the first connection portion 15 of the first cover 10*b* further includes a concave area 151*a*. Preferably but not exclusively, the concave area 151*a* is a groove, and the adhesive layer 40 is at least partially accommodated in the concave area 151*a*, so that the contact area between the adhesive layer 40 and the first connection portion 15 is increased, and the assembling effect of the first cover 10*b* and the second cover 20 through the adhesive layer 40 is improved. In an embodiment, as shown in FIG. 19C, the first connection portion 15 of the first cover 10*a* further includes a concave area 151, and the second connection portion 25 of the second cover 20*a* further includes a concave area 251. Preferably but not exclusively, the concave area 151 of the first connection portion 15 and the concave area 251 are spatially corresponded to each other, and the adhesive layer 40 is at least partially accommodated in the concave area 151 and the concave area 251, so that the contact area between the adhesive layer 40 and the first connection portion 15 and the contact area between the adhesive layer 40 and the second connection portion 25 are increased, and the assembling effect of the first cover 10*a* and the second cover 20*a* through the adhesive layer 40 is improved. In an embodiment, as shown in FIG. 19D, the first connection portion 15 of the first cover 10*b* further includes a concave area 151*a*, and the second connection portion 25 of the second cover 20*b* further includes a concave area 251*a*. Preferably but not exclusively, the concave area 151*a* and the concave area 251*a* are a groove, respectively and spatially corresponded to each other, and the adhesive layer 40 is at least partially accommodated in the concave area 151*a* and the concave area 251*a*, so that the contact area between the adhesive layer 40 and the first connection portion 15 and the contact area between the adhesive layer 40 and the second connection portion 25 are increased, and the assembling effect of the first cover 10*b* and the second cover 20*b* through the adhesive layer 40 is improved. Certainly, in other embodiments, the first connection portion 15 and the second connection portion 25 further includes a structural surface, such as a rough surface or a notched structure to increase the surface area thereof. It facilitates the adhesive layer 40 to connect the first cover 10 and the second cover 20 effectively. The present disclosure is not limited thereto and not redundantly described herein.

Figure 20:
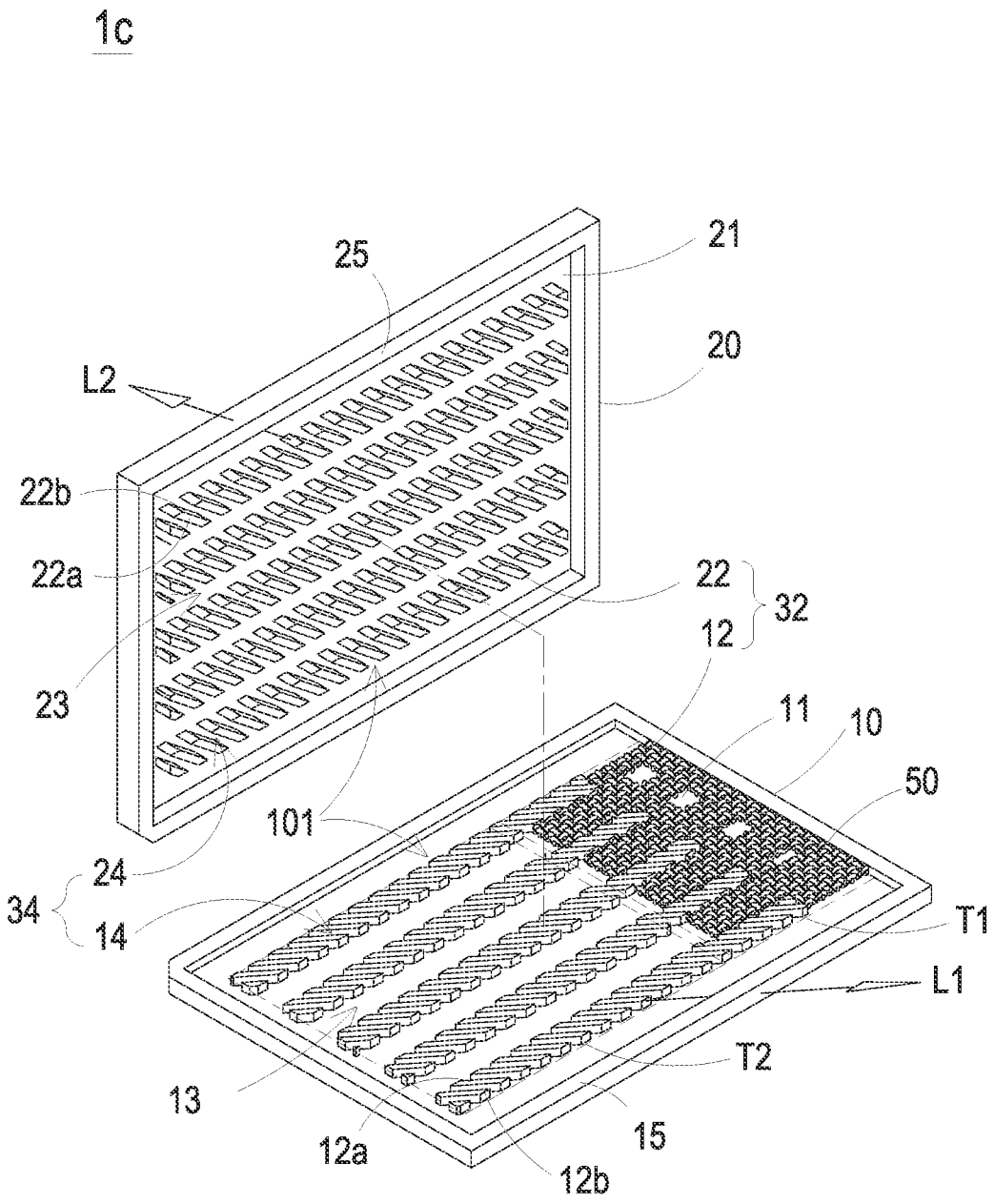
FIG. 20 shows an exploded view of the thin vapor-chamber structure according to a fourth embodiment of the present disclosure.
Figure 21:
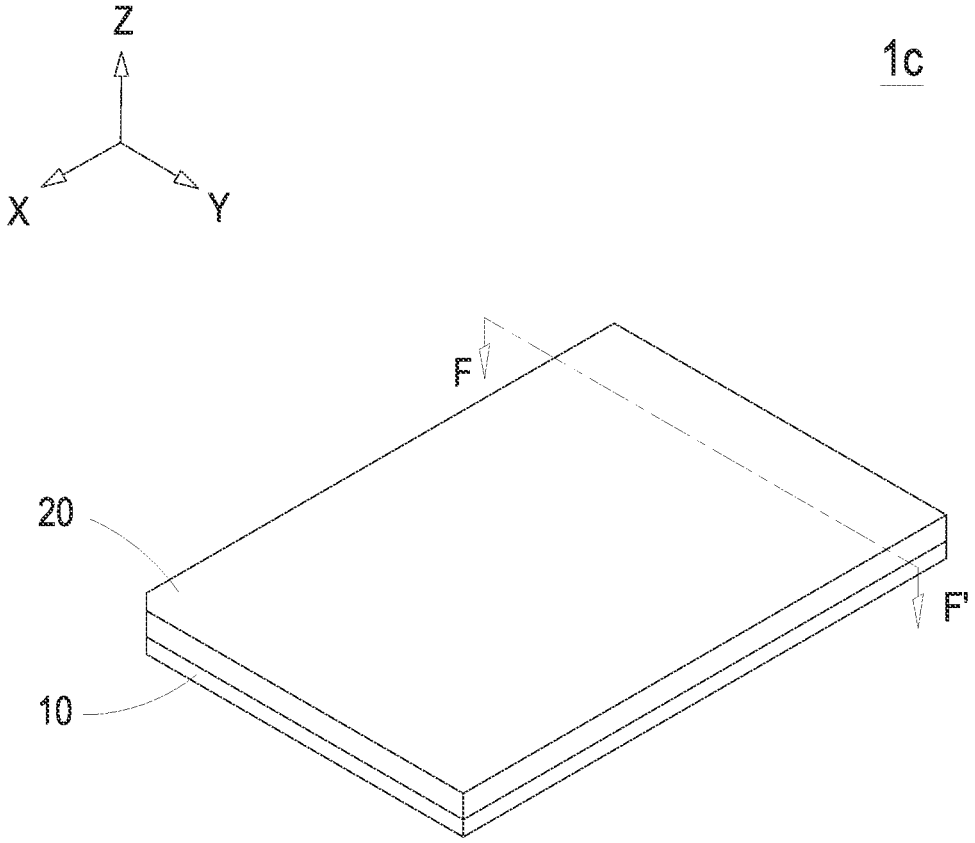
FIG. 21 shows a perspective view of the thin vapor-chamber structure according to the fourth embodiment of the present disclosure.
Figure 22:
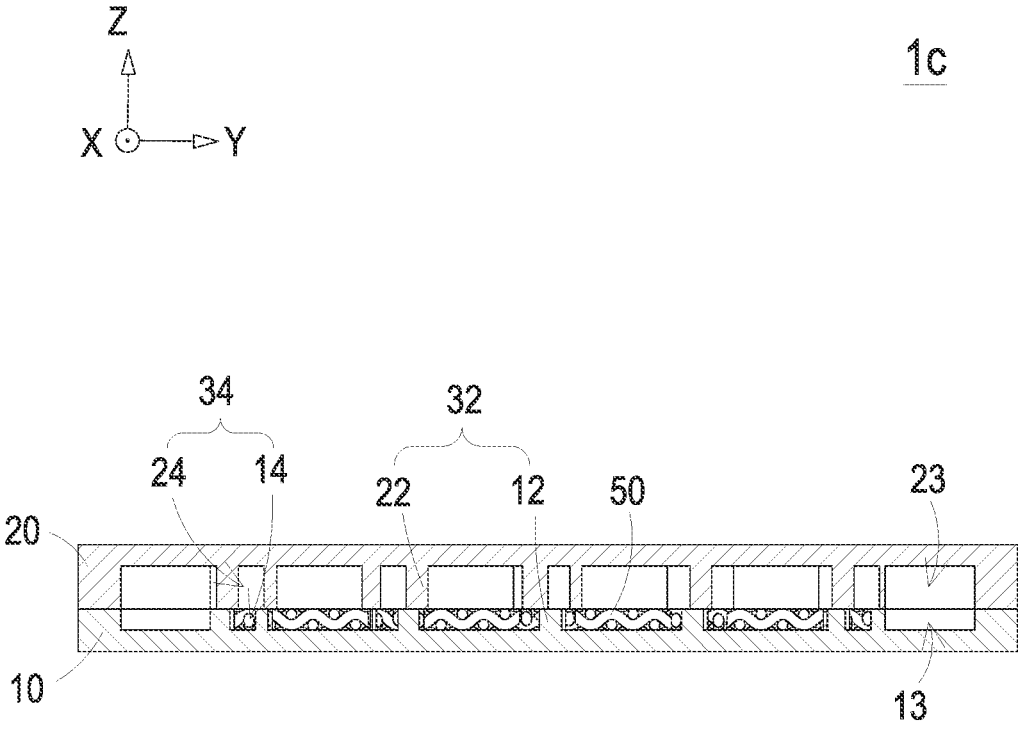
FIG. 22 shows a cross-sectional view of the thin vapor-chamber structure of FIG. 21 taken along the line F-F'.

FIG. 20 shows an exploded view of the thin vapor-chamber structure according to a fourth embodiment of the present disclosure. FIG. 21 shows a perspective view of the thin vapor-chamber structure according to the fourth embodiment of the present disclosure. FIG. 22 shows a cross-sectional view of the thin vapor-chamber structure of FIG. 21 taken along the line F-F'. In the embodiment, the structures, elements and functions of the thin vapor-chamber structure 1*c* are similar to those of the thin vapor-chamber structure 1 in FIGS. 1 to 12. The elements and features indicated by the numerals similar to those of the first embodiment mean similar elements and features, and are not redundantly described herein. In the embodiment, the thin vapor-chamber structure 1*c* further includes a screen mesh 50 disposed within the accommodation space 101 and located at a part of the flow channels 33. Preferably but not exclusively, the screen mesh 50 is made by copper. Preferably but not exclusive, the thin vapor-chamber structure 1*c* is attached to the heat source through the first cover 1, and the screen mesh 50 is disposed in the first lateral interval 13 of the first cover 10 and located at the evaporation zone T1 instead of the second lateral interval 23 of the second cover 20 and the condensation zone T2. Cooperated with the micro-channel 34 of the wick 32, the screen mesh 50 disposed nearby the evaporation zone T1 further improve the flow resistance and the capillary force therearound. Thus, heat dissipation efficiency of the thin vapor-chamber structure 1*c* is further enhanced. Preferably but not exclusively, the height of the screen mesh 50 is equal to or less than the first height H1 of the first protruding strip 12*a* of the first cover 10 (Referring to FIG. 10). Certainly, the present disclosure is not limited thereto.

Figure 23:
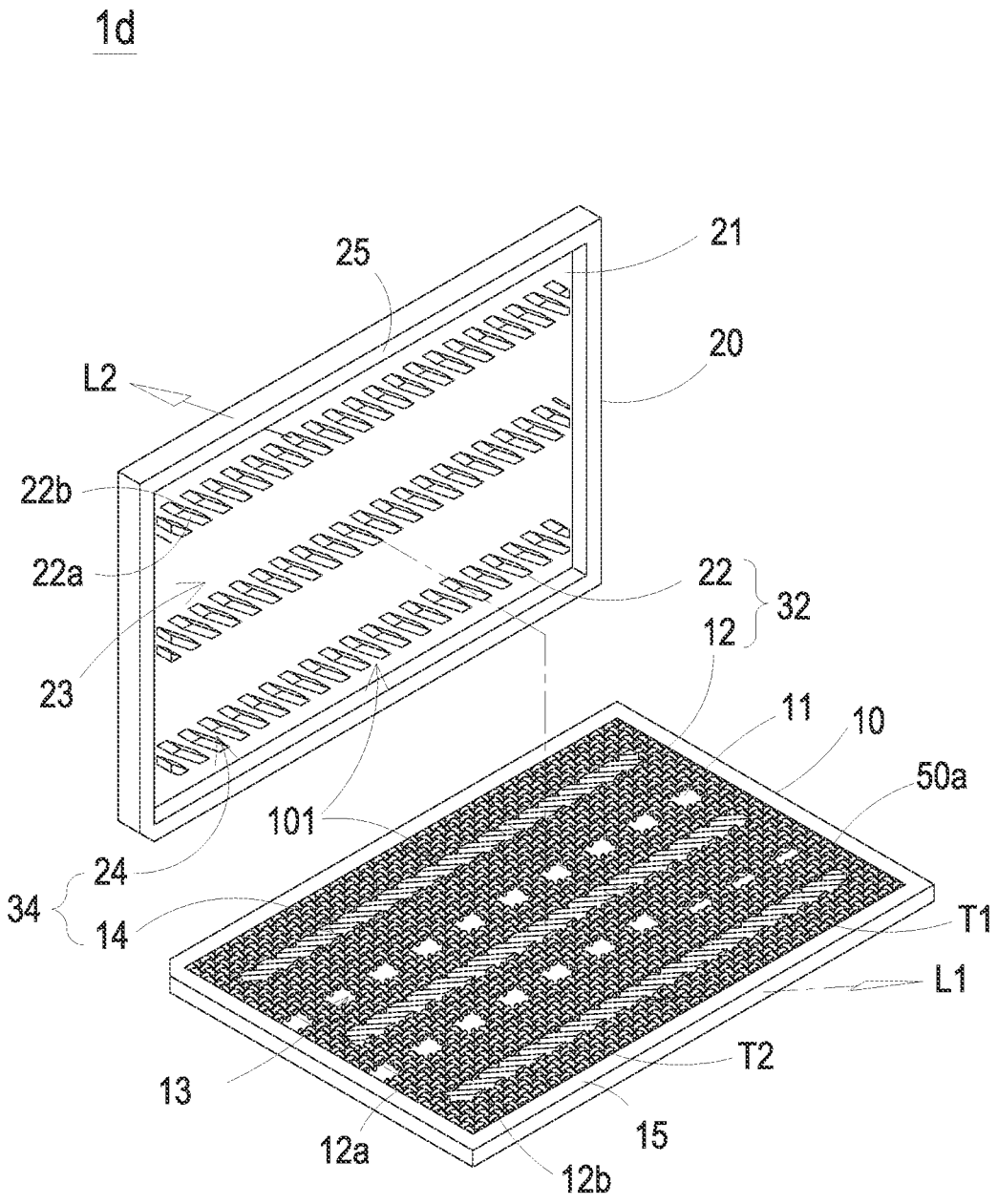
FIG. 23 shows an exploded view of the thin vapor-chamber structure according to a fifth embodiment of the present disclosure.

FIG. 23 shows an exploded view of the thin vapor-chamber structure according to a fifth embodiment of the present disclosure. In the embodiment, the structures, elements and functions of the thin vapor-chamber structure 1*d* are similar to those of the thin vapor-chamber structure 1*c* in FIGS. 20 to 22. The elements and features indicated by the numerals similar to those of the first embodiment mean similar elements and features, and are not redundantly described herein. Different from the screen mesh 50 of the thin vapor-chamber structure 1*c*, in the embodiment, the screen mesh 50*a* of the thin vapor-chamber structure 1*d* is disposed in the first lateral interval 13 of the first cover 10 and located at the evaporation zone T1 and the condensation zone T2. Preferably but not exclusively, the screen mesh 50*a* is excluded from the second lateral interval 23 of the second cover 20 when the first cover 10 of the thin vapor-chamber structure 1*d* is attached to the heat source. Preferably but not exclusively, the height of the screen mesh 50*a* is equal to or less than the first height H1 of the first protruding strip 12*a* of the first cover 10 (Referring to FIG. 10). In other embodiments, the arrangement and the height of the screen mesh 50*a* are adjustable according to the practical requirements. The present disclosure is not limited thereto.

Figure 24:
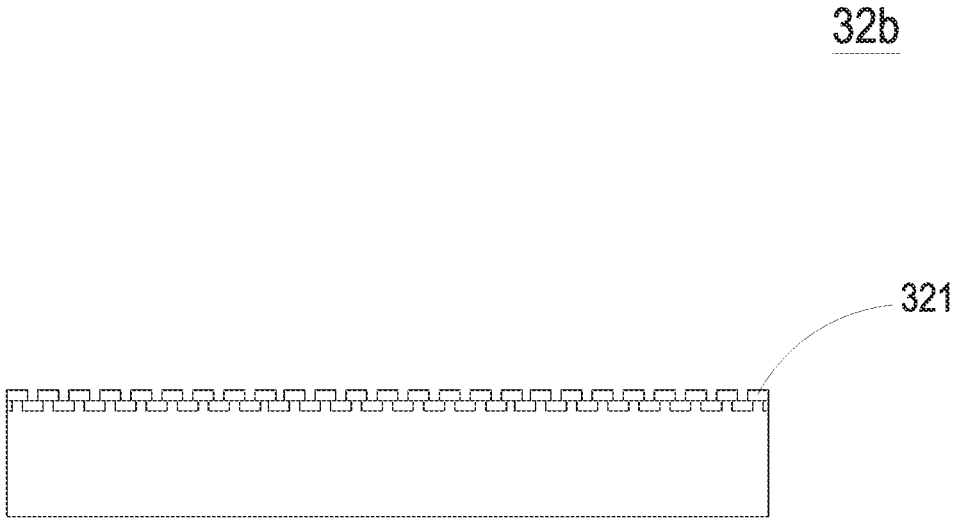
FIG. 24 shows an exemplary micro-structure of the wick of the present disclosure.

Notably, in the above embodiment, the wick 32 is a micro-structure formed on the first cover 10 and the second cover 20. Preferably but not exclusively, the micro-structure is formed by etching. FIG. 24 shows an exemplary micro-structure of the wick of the present disclosure. In the embodiment, the wick 32*b* of present disclosure further includes a nanostructure 321 disposed on the outer surface. Preferably but not exclusively, the nanostructure 321 is a nanowire formed by tungsten oxide or a nanotube formed by titanium oxide. With the nanostructure 321 on the wick 32*b* of the present disclosure, the surface of the wick 32*b* is modified to increase hydrophilicity. Thus, the capillary force of the wick 32*b* is improved. Moreover, the performance of the product is enhanced. Certainly, the present disclosure is not limited thereto.

In summary, the present disclosure provides a thin vapor-chamber structure. The clustered patterns on two covers are in contact connection to form a wick having at least one micro-channel, so as to provide a required wicking power for the liquid-phase fluid to flow back from the condensation zone to the evaporation zone. It effectively eliminates that the liquid-phase liquid is interfered with the vapor-phase liquid flowing from the evaporation zone to the condensation zone. The wicking power refers to the facilitation of the fluid, including the vapor-phase fluid and the liquid-phase fluid, flowing in circulation of evaporation and condensation. The effectiveness of the wicking power is related to the flow resistance and the capillary force. Since the protruding stripes on the two coves are arranged and extended along different directions, the protruding stripes on the two covers are overlapped and contacted to form a micro-channel, which meanders between the surfaces of the two covers. Thus, the liquid-phase fluid flows from the condensation zone back to the evaporation zone through the continuous micro-channel, and the required wick power is provided by two lateral walls of the protruding stripes for the fluid flowing from the condensation zone back to the evaporation zone. The flow resistance and the capillary force are inversely proportional to the height of the protruding stripes on the two covers, are directly proportional to the width of the protruding stripes on the two covers, and are inversely proportional to the spacing distance of two adjacent protruding stripes on the two covers, so that the recirculation efficiency of the fluid flowing from the condensation zone back to the evaporation zone are controlled. Furthermore, the performance of the wicking power is adjustable by changing the height and the width of the protruding stripes and the spacing distance of two adjacent protruding stripes, but is not limited to the planar dimensions of the two covers. On the other hand, the micro-channel of the wick and the flow channel located adjacent to the wick are in fluid communication with each other, so that the flow of the liquid-phase fluid in the micro-channel and the flow of the vapor-phase fluid in the flow channel are not interfered with each other. Thus, the vapor-phase fluid formed by evaporation from the evaporation zone flows through the flow channel, and the liquid-phase fluid formed by condensation from the condensation zone flows through the micro-channel, respectively. The interference caused by the mutual flows relative to each other is effectively eliminated. It also prevents the fluid from causing droplets scattering and affecting the performance of the vapor-chamber structure. In addition, the protruding stripes of the clustered patterns on the two covers are arranged and extended along different directions, respectively. When the two covers are assembled, the protruding stripes on the two covers are in contact connection to each other, thereby forming the micro-channel, which meanders between the surfaces of the two covers. In conjunction with the corresponding condensation zone and the evaporation zone of the thin vapor-chamber structure in use, the clustered patterns on the two covers are adjustable correspondingly according to the length, the width or the shape of the two ends of the protruding stripes. Moreover, the density of the protruding stripes of the clustered patterns are adjustable, so as to meet the requirements of practical applications and increase the diversity of products. On the other hand, in addition to being assembled by diffusion bonding or brazing, the two covers are connected by an adhesive layer. It is beneficial to realize the contact connection of the protruding stripes on the two covers, simplify the process time, and reduce energy consumption. It further avoids the oxidation phenomenon caused by high-temperature and high-pressure assembly, which affects the contact connection of the protruding stripes on the two covers and the overall performance of the thin vapor-chamber structure.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A thin vapor-chamber structure comprising:

a first cover having a first surface and a first clustered pattern, wherein the first clustered pattern is disposed on the first surface and comprises a plurality of first protruding stripes, wherein the plurality of first protruding stripes are spaced apart from each other and extended along a first direction;

a second cover having a second surface and a second clustered pattern, wherein the first surface faces the second surface, the first cover and the second cover are assembled to form an accommodation space, and the first clustered pattern and the second clustered pattern are spatially corresponded and connected to each other to form a wick, wherein the wick divides the accommodation space into at least two flow channels located at two opposite sides of the wick, wherein the second clustered pattern is disposed on the second surface and comprises a plurality of second protruding stripes, wherein the plurality of second protruding stripe are spaced apart from each other and extended along a second direction, and the first direction and the second direction are non-identical, wherein the plurality of first protruding stripes and the plurality of second protruding stripes are partially contacted to each other and configured to form at least one micro-channel in fluid communication with the at least two flow channels; and a fluid accommodated within the accommodation space, wherein when the fluid flows through the at least one micro-channel, a capillary force generated by the plurality of first protruding stripes and the plurality of second protruding stripes provides a wicking power, so that the fluid smoothly flows in a recirculation through the flow channels and the micro-channel, wherein a first space is formed between each two of the adjacent first protruding stripes, a second space is formed between each tow of the adjacent second protruding stripes, and the first space and the second space are fluid communication with each other to form the at least one micro-channel, wherein the first direction or the second direction is neither perpendicular nor parallel to the at least two flow channels.

2. The thin vapor-chamber structure according to claim 1, wherein the first direction and the second direction form an angle, and the angle is ranged from 20° to 160°.

3. The thin vapor-chamber structure according to claim 1, wherein each two adjacent first protruding stripes have a first spacing distance, and the first spacing distance is ranged from 50 microns to 300 microns, wherein the capillary force is inversely proportional to the first spacing distance.

4. The thin vapor-chamber structure according to claim 1, wherein the first protruding stripe has a first height and a first width, the first height is ranged from 10 microns to 200 microns, and the first width is ranged from 50 microns to 500 microns.

5. The thin vapor-chamber structure according to claim 4, wherein the capillary force is inversely proportional to the first height of the first protruding stripe, and the capillary force is directly proportional to the first width of the first protruding stripe.

6. The thin vapor-chamber structure according to claim 1, wherein each two adjacent second protruding stripes have a second spacing distance, and the second spacing distance is ranged from 50 microns to 300 microns, wherein the capillary force is inversely proportional to the second spacing distance.

7. The thin vapor-chamber structure according to claim 1, wherein the second protruding stripe has a second height and a second width, the second height is ranged from 10 microns to 200 microns, and the second width is ranged from 50 microns to 500 microns.

8. The thin vapor-chamber structure according to claim 7, wherein the capillary force is inversely proportional to the second height of the second protruding stripe, and the capillary force is directly proportional to the second width of the second protruding stripe.

9. The thin vapor-chamber structure according to claim 1, further comprising an evaporation zone and a condensation zone, wherein the first clustered pattern includes at least two first sub-clustered patterns, the second clustered pattern includes at least two second sub-clustered patterns, and the at least two first sub-clustered patterns and the at least two second sub-clustered patterns are connected to form the wick disposed in the evaporation zone and the condensation zone, wherein the at least two first sub-clustered patterns are spaced apart from each other in the condensation zone and converged in the evaporation zone, wherein the at least two second sub-clustered patterns are spaced apart from each other in the condensation zone and converged in the evaporation zone.

10. The thin vapor-chamber structure according to claim 1, wherein both of the first protruding stripe and the second protruding stripe have a first end portion and a second end portion, and each of the first end portion and the second end portion includes at least one selected from the group consisting of a plane, a bevel, an arc, a triangle and an irregular surface.

11. The thin vapor-chamber structure according to claim 1, wherein the first cover comprises a first connection portion disposed around a peripheral edge of the first cover, and the second cover comprises a second connection portion disposed around a peripheral edge of the second cover and spatially corresponded to the first connection portion, wherein the first connection portion and the second connection portion are connected to each other so that the first cover and the second cover are assembled to form the accommodation space.

12. The thin vapor-chamber structure according to claim 11, further comprising an adhesive layer disposed between the first connection portion and the second connection portion, wherein at least one of the first connection portion and the second connection portion comprises at least one concave area, and the adhesive layer is partially received in the concave area, wherein the adhesive layer comprises at least one selected from the group consisting of a glue, an adhesive, a tape, a binder and an epoxy resin.

13. The thin vapor-chamber structure according to claim 1, further comprising a screen mesh disposed within the accommodation space, wherein the screen mesh is made by copper.

14. The thin vapor-chamber structure according to claim 1, wherein the wick further comprises a nanostructure disposed thereon, wherein the nanostructure is a nanowire or a nanotube, and formed by tungsten oxide or titanium oxide.

15. A thin vapor-chamber structure comprising:

a first cover having a first surface and a first clustered pattern, wherein the first clustered pattern is disposed on the first surface and comprises a plurality of first protruding stripes, wherein the plurality of first protruding stripes are spaced apart from each other and extended along a first direction; and a second cover having a second surface and a second clustered pattern, wherein the first surface faces the second surface, wherein the second clustered pattern is disposed on the second surface and comprises a plurality of second protruding stripes, the plurality of second protruding stripe are spaced apart from each other and extended along a second direction, and the first direction and the second direction are non-identical, wherein the first clustered pattern and the second clustered pattern are spatially corresponded and in contact connection to each other to form a wick, and lateral walls of the plurality of first protruding stripes and lateral walls of the plurality of second protruding stripes are configured to form at least one micro-channel meandering between the first surface and the second surface, wherein the first cover and the second cover are assembled to form an accommodation space, and the wick divides the accommodation space into at least two flow channels located at two opposite sides of the wick, wherein a first space is formed between each two of the adjacent first protruding stripes, a second space is formed between each two of the adjacent seconds protruding stripes, and the first space and the second space are in fluid communication with each other to form the at least one micro-channel, wherein the first direction or the second direction is neither perpendicular nor parallel to the at least two flow channels.

16. The thin vapor-chamber structure according to claim 15, further comprising a fluid, wherein when the fluid flows through the at least one micro-channel, a capillary force generated by the plurality of first protruding stripes and the plurality of second protruding stripes provides a wicking power, so that the fluid smoothly flows in a recirculation.

17. The thin vapor-chamber structure according to claim 16, further comprising an evaporation zone, a condensation zone and at least one flow channel, wherein the fluid comprises a vapor-phase fluid and a liquid-phase fluid, the liquid-phase fluid evaporates into the vapor-phase fluid in the evaporation zone, the vapor-phase fluid flows through the at least one flow channel to the condensation zone and condenses into the liquid-phase fluid, and the liquid-phase fluid flows to the evaporation zone through the at least one micro-channel.

18. The thin vapor-chamber structure according to claim 15, wherein the first cover comprises a first connection portion disposed around a peripheral edge of the first cover, and the second cover comprises a second connection portion disposed around a peripheral edge of the second cover and spatially corresponded to the first connection portion, wherein the first connection portion and the second connection portion are connected to each other, and the plurality of first protruding stripes of the first clustered pattern and the plurality of second protruding stripes of the second clustered pattern are in contact connection to form the wick.

19. The thin vapor-chamber structure according to claim 18, further comprising an adhesive layer disposed between the first connection portion and the second connection portion, wherein the adhesive layer comprises at least one selected from the group consisting of a glue, an adhesive, a tape, a binder and an epoxy resin.

20. The thin vapor-chamber structure according to claim 19, wherein at least one of the first connection portion and the second connection portion comprises at least one concave area, and the adhesive layer is partially received in the concave area.

* * * * *